US007271361B2

(12) United States Patent
Sugimura et al.

(10) Patent No.: US 7,271,361 B2
(45) Date of Patent: Sep. 18, 2007

(54) INPUT KEY AND INPUT APPARATUS

(75) Inventors: Toshiaki Sugimura, Yokohama (JP); Masaaki Fukumoto, Yokohama (JP)

(73) Assignee: NTT DoCoMo, Inc., Tokyo (JP)

( * ) Notice: Subject to any disclaimer, the term of this patent is extended or adjusted under 35 U.S.C. 154(b) by 361 days.

(21) Appl. No.: 10/983,748

(22) Filed: Nov. 9, 2004

(65) Prior Publication Data

US 2005/0123333 A1 Jun. 9, 2005

(30) Foreign Application Priority Data

Dec. 4, 2003 (JP) ..... 2003-406230
Oct. 5, 2004 (JP) ..... 2004-292915

(51) Int. Cl.
*H01H 13/14* (2006.01)
*H01H 3/12* (2006.01)

(52) U.S. Cl. ..... 200/341; 200/5 A; 200/520; 338/47; 400/479; 400/490; 341/22

(58) Field of Classification Search ..... 200/341, 200/5 A, 6 A, 520; 338/47, 95, 96, 99; 341/22–24; 400/479, 485, 490, 493–494
See application file for complete search history.

(56) References Cited

U.S. PATENT DOCUMENTS

| | | | | |
|---|---|---|---|---|
| 5,528,235 | A * | 6/1996 | Lin et al. | 341/22 |
| 6,067,005 | A * | 5/2000 | DeVolpi | 338/47 |
| 6,201,468 | B1 * | 3/2001 | DeVolpi | 338/47 |
| 2004/0119687 | A1 * | 6/2004 | Suzuki et al. | 345/156 |

FOREIGN PATENT DOCUMENTS

| | | |
|---|---|---|
| CN | 1327606 A | 12/2001 |
| EP | 1 146 531 B1 | 10/2001 |
| JP | 9-222948 | 8/1997 |
| JP | 11-237945 | 8/1999 |
| JP | 2002-55757 | 2/2002 |

* cited by examiner

*Primary Examiner*—K. Lee
(74) *Attorney, Agent, or Firm*—Oblon, Spivak, McClelland, Maier & Neustadt, P.C.

(57) ABSTRACT

An input key of the present invention, which is assigned a plurality of information items to be inputted, and which is assigned each of the information items to be inputted, according to a direction of a force exerted on the input key. And the input key includes a push detecting means for detecting a push on the input key, and a direction detecting means for, when the push detecting means detects a push on the input key, detecting a strain occurring in the input key and thereby detecting a direction of a force exerted on the input key.

4 Claims, 49 Drawing Sheets

Fig.10

| DIRECTION | CONDITION | |
|---|---|---|
| LEFT | $B \geqq A + \alpha_1$ | $\lvert E-F \rvert \leqq \beta$ |
| | $D \geqq C + \alpha_2$ | $\lvert G-H \rvert \leqq \beta$ |
| RIGHT | $A \geqq B + \alpha_1$ | $\lvert E-F \rvert \leqq \beta$ |
| | $C \geqq D + \alpha_2$ | $\lvert G-H \rvert \leqq \beta$ |
| UP | $F \geqq E + \alpha_1$ | $\lvert A-B \rvert \leqq \beta$ |
| | $H \geqq G + \alpha_2$ | $\lvert C-D \rvert \leqq \beta$ |
| DOWN | $E \geqq F + \alpha_1$ | $\lvert A-B \rvert \leqq \beta$ |
| | $G \geqq H + \alpha_2$ | $\lvert C-D \rvert \leqq \beta$ |

Fig.11

(a)

| NAME OF KEY | KEY 10a |
|---|---|
| DIRECTION | DETECTION COUNT |
| CENTER | 0 |
| UP | 0 |
| RIGHT | 0 |
| DOWN | 0 |
| LEFT | 0 |

(b)

| NAME OF KEY | KEY 10a |
|---|---|
| DIRECTION | DETECTION COUNT |
| CENTER | 60 |
| UP | 0 |
| RIGHT | 90 |
| DOWN | 0 |
| LEFT | 0 |

*Fig.12*

| KEY | DIRECTION | SYMBOL |
|---|---|---|
| KEY 10a | CENTER | お |
| | UP | あ |
| | RIGHT | い |
| | DOWN | う |
| | LEFT | え |

Fig.16

| DIRECTION | CONDITION | |
|---|---|---|
| LEFT | $D \geqq A + \alpha$ | $\lvert E-H \rvert \leqq \beta$ |
| RIGHT | $A \geqq D + \alpha$ | $\lvert E-H \rvert \leqq \beta$ |
| UP | $H \geqq E + \alpha$ | $\lvert A-D \rvert \leqq \beta$ |
| DOWN | $E \geqq H + \alpha$ | $\lvert A-D \rvert \leqq \beta$ |

*Fig.20*

| DIRECTION | CONDITION | |
|---|---|---|
| LEFT | $B \geqq A+\alpha$ | $\lvert C-D \rvert \leqq \beta$ |
| RIGHT | $A \geqq B+\alpha$ | $\lvert C-D \rvert \leqq \beta$ |
| UP | $D \geqq C+\alpha$ | $\lvert A-B \rvert \leqq \beta$ |
| DOWN | $C \geqq D+\alpha$ | $\lvert A-B \rvert \leqq \beta$ |

*Fig.21*

| DIRECTION | CONDITION |
|---|---|
| LEFT | ALL DIRECTIONS IN STRAIN GAGES 70a-70d ARE LEFT |
| RIGHT | ALL DIRECTIONS IN STRAIN GAGES 70a-70d ARE RIGHT |
| UP | ALL DIRECTIONS IN STRAIN GAGES 70a-70d ARE UP |
| DOWN | ALL DIRECTIONS IN STRAIN GAGES 70a-70d ARE DOWN |

Fig.24
(a)
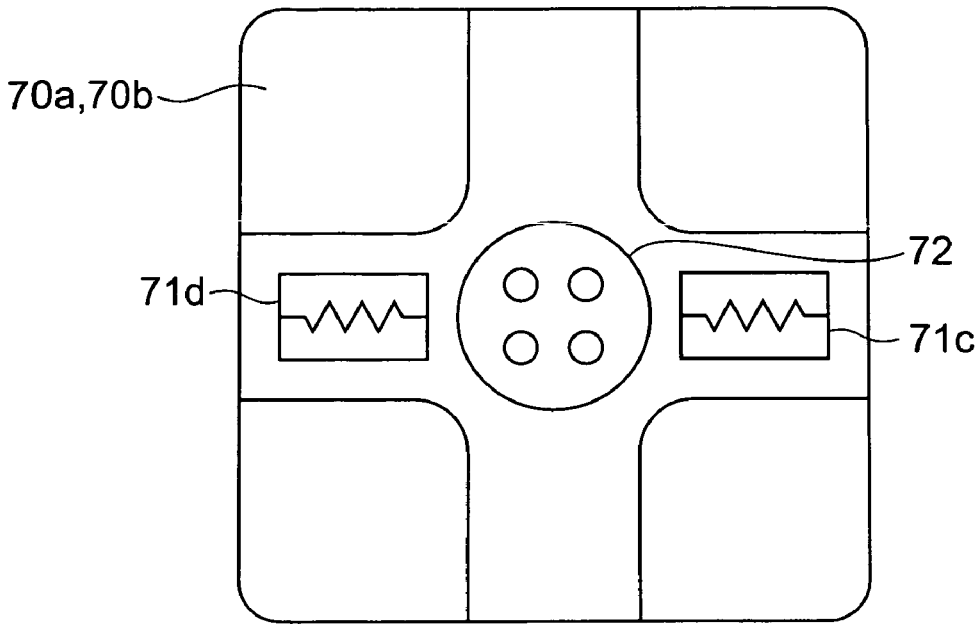
(b)
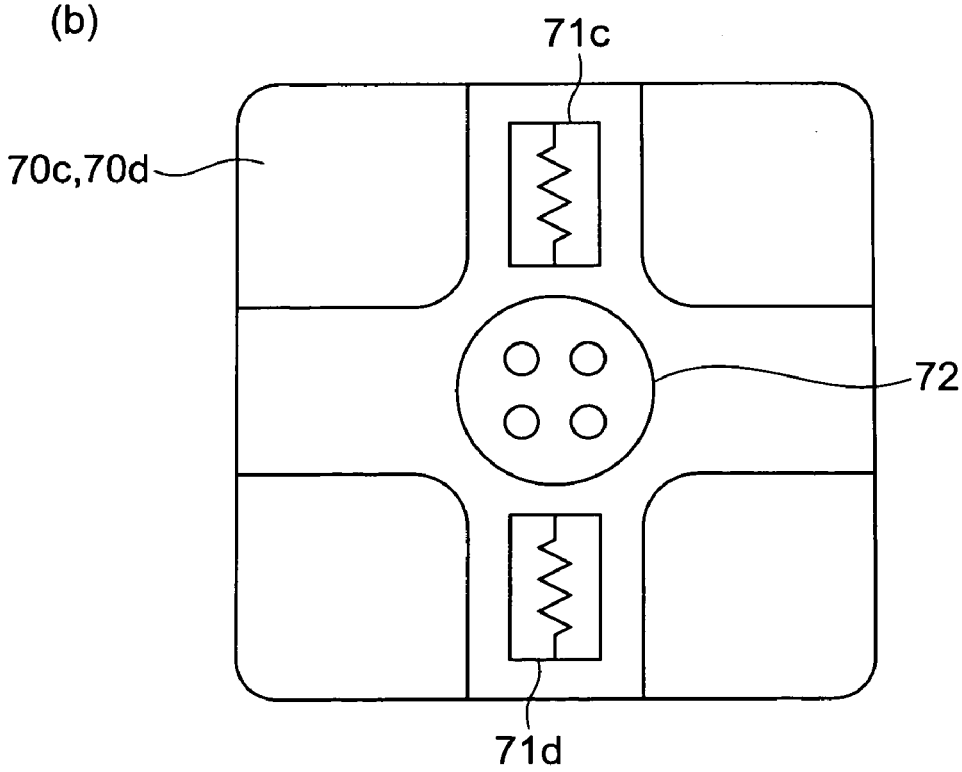

Fig.25

(a)

| DIRECTION | CONDITION |
|---|---|
| LEFT | $C \geqq D + \alpha$ |
| RIGHT | $D \geqq C + \alpha$ |

(b)

| DIRECTION | CONDITION |
|---|---|
| UP | $D \geqq C + \alpha$ |
| DOWN | $C \geqq D + \alpha$ |

*Fig.26*

| DIRECTION | CONDITION |
|---|---|
| LEFT | DIRECTIONS IN STRAIN GAGES 70a AND 70b ARE "LEFT," AND DIRECTIONS IN STRAIN GAGES 70c AND 70d ARE NEITHER "UP" NOR "DOWN" |
| RIGHT | DIRECTIONS IN STRAIN GAGES 70a AND 70b ARE "RIGHT," AND DIRECTIONS IN STRAIN GAGES 70c AND 70d ARE NEITHER "UP" NOR "DOWN" |
| UP | DIRECTIONS IN STRAIN GAGES 70c AND 70d ARE "UP," AND DIRECTIONS IN STRAIN GAGES 70a AND 70b ARE NEITHER "LEFT" NOR "RIGHT" |
| DOWN | DIRECTIONS IN STRAIN GAGES 70c AND 70d ARE "DOWN," AND DIRECTIONS IN STRAIN GAGES 70a AND 70b ARE NEITHER "LEFT" NOR "RIGHT" |

Fig.28

| DIRECTION | CONDITION |
|---|---|
| LEFT | DIRECTION IN STRAIN GAGE 70a IS "LEFT," AND DIRECTION IN STRAIN GAGE 70c IS NEITHER "UP" NOR "DOWN" |
| RIGHT | DIRECTION IN STRAIN GAGE 70a IS "RIGHT," AND DIRECTION IN STRAIN GAGE 70c IS NEITHER "UP" NOR "DOWN" |
| UP | DIRECTION IN STRAIN GAGE 70c IS "UP," AND DIRECTION IN STRAIN GAGE 70a IS NEITHER "LEFT" NOR "RIGHT" |
| DOWN | DIRECTION IN STRAIN GAGE 70c IS "DOWN," AND DIRECTION IN STRAIN GAGE 70a IS NEITHER "LEFT" NOR "RIGHT" |

Fig.35
(a)
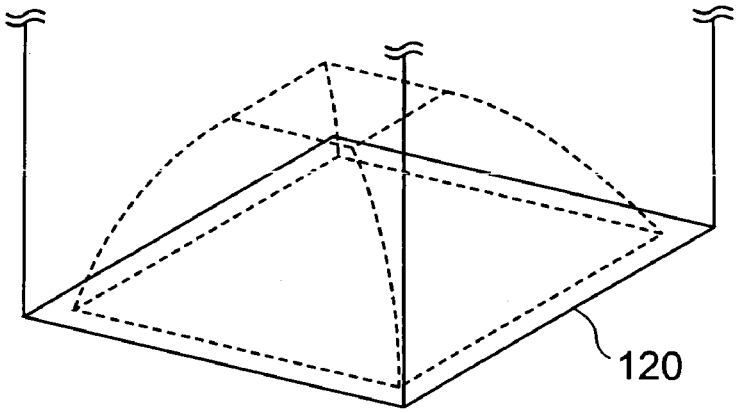
(b)
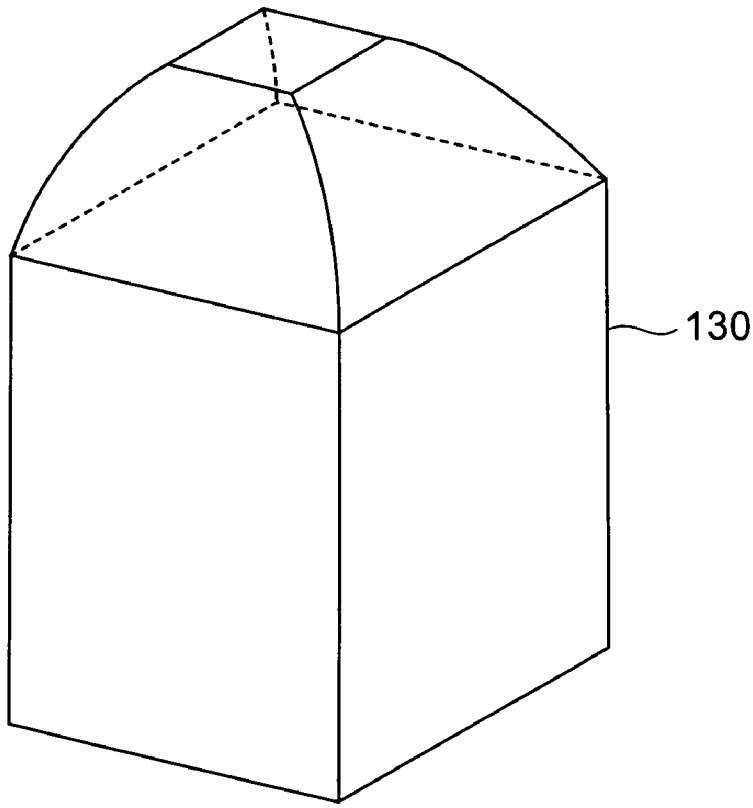

Fig.39

| KEY No. | K1 | K2 | K3 | K4 | K5 | K6 | K7 | K8 | K9 | K10 | K11 | K12 |
|---|---|---|---|---|---|---|---|---|---|---|---|---|
| CENTER | あ | か | さ | た | な | は | ま | や | ら | を | ん | DOWNSHIFT |
| UP | い | き | し | ち | に | ひ | み | ゐ | り | わ | (JAPANESE COMMA) | CONVERSION TO VOICED CONSONANT |
| DOWN | う | く | す | つ | ぬ | ふ | む | ゆ | る | ー (LONG SOUND) | (JAPANESE PERIOD) | CONVERSION TO P-SOUND |
| LEFT | え | け | せ | て | ね | へ | め | ゑ | れ | ? | (COMMA) | CONVERSION TO SMALL KATAKANA |
| RIGHT | お | こ | そ | と | の | ほ | も | よ | ろ | ! | (CENTERED DOT) | CONVERSION TO LARGE KATAKANA |

Fig.40

| KEY No. | K1 | K2 | K3 | K4 | K5 | K6 | K7 | K8 | K9 | K10 | K11 | K12 |
|---|---|---|---|---|---|---|---|---|---|---|---|---|
| CENTER | A | F | K | P | U | Z | , | . | ? | : | ; | — |
| UP | B | G | L | Q | V | CR | ' | + | @ | { | < | = |
| DOWN | C | H | M | R | W | TAB | " | * | $ | } | > | ~ |
| LEFT | D | I | N | S | X | [ | ` | / | ¥ | ( | Back Space | – |
| RIGHT | E | J | O | T | Y | ] | # | % | & | ) | ESC | \| |

Fig.42

(a)

| KEY No. | K1 | K2 | K3 | K4 | K5 |
|---|---|---|---|---|---|
| CENTER | b | h | n | i | z |
| UP | c | j | p | t | zh |
| DOWN | ch | k | q | w | |
| LEFT | f | l | r | x | |
| RIGHT | g | m | s | y | |

(b)

| KEY No. | K1 | K2 | K3 | K4 | K5 | K6 | K7 |
|---|---|---|---|---|---|---|---|
| CENTER | a | e | i | in | ong | ia | uo |
| UP | ai | ei | iang | uai | iu | uan | o |
| DOWN | an | en | uang | ing | ou | ui | u |
| LEFT | ang | eng | iao | ng | u | ue | ue |
| RIGHT | ao | er | ie | iong | ua | un | |

Fig.43

| KEY No. | K1 | K2 | K3 | K4 | K5 | K6 | K7 | K8 |
|---|---|---|---|---|---|---|---|---|
| CENTER | ㄱ | ㄲ | ㄴ | ㄷ | ㅓ | ㅐ | ㅑ | ㅐ |
| UP | ㄸ | ㄹ | ㅁ | ㅁ | ㅗ | ㅔ | ㅕ | ㅔ |
| DOWN | ㅃ | ㅅ | ㅅ | ㅇ | ㅛ | ㅘ | ㅒ | ㅚ |
| LEFT | ㅈ | ㅉ | ㅊ | ㅍ | ㅜ | ㅜ | ㅝ | ㅟ |
| RIGHT | ㅌ | ㅍ | ㅎ | ㅏ | ㅡ | ㅠ | ㅡ | ㅣ |

163

Fig.48
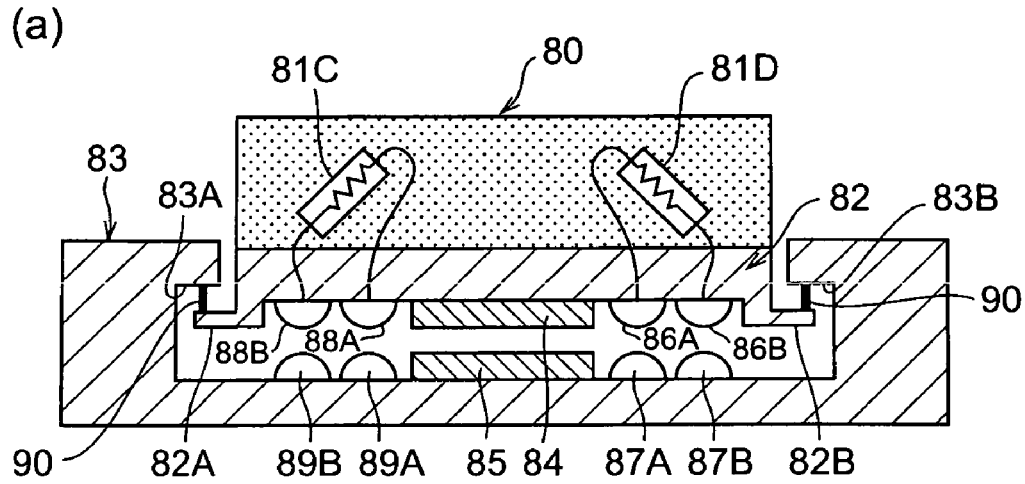
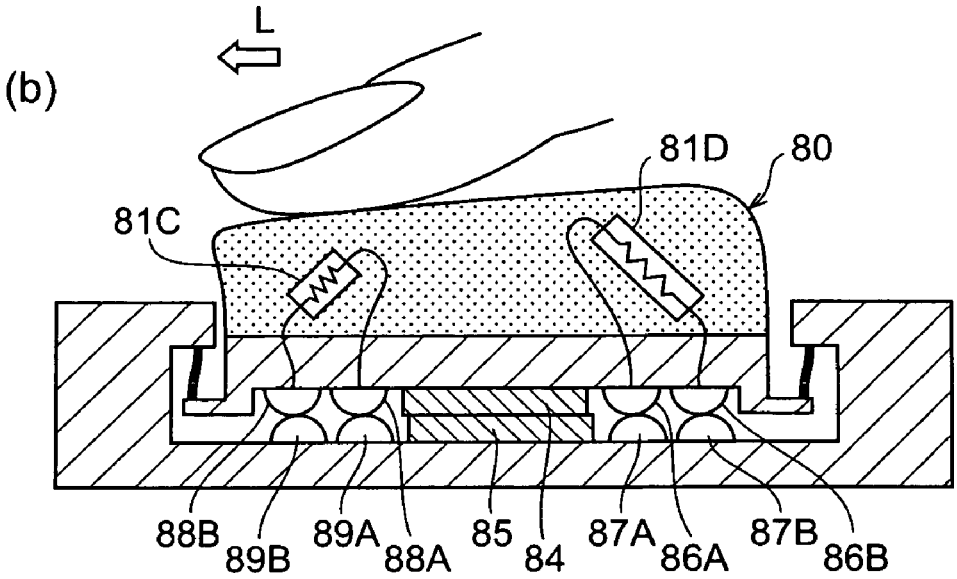

Fig.49

| DIRECTION | CONDITION | |
|---|---|---|
| LEFT | $D \geqq C + \alpha$ | $\lvert A-B \rvert \leqq \beta$ |
| RIGHT | $C \geqq D + \alpha$ | $\lvert A-B \rvert \leqq \beta$ |
| UP | $B \geqq A + \alpha$ | $\lvert C-D \rvert \leqq \beta$ |
| DOWN | $A \geqq B + \alpha$ | $\lvert C-D \rvert \leqq \beta$ |

INPUT KEY AND INPUT APPARATUS

BACKGROUND OF THE INVENTION

1. Field of the Invention

The present invention relates to an input apparatus having at least one input key assigned a plurality of information items to be inputted, and to the input key.

2. Related Background Art

The portable terminals such as cell phones need to be compact enough to be carried by users. For this reason, where the portable terminals are provided with a keyboard, the number of keys in the keyboard is often much smaller than that in the so-called full keyboard.

In the case as described above, it is common practice to assign one key a plurality of symbols. A conventionally proposed method of inputting a plurality of symbols through one key is to detect a direction of a force exerted on the key and input an independent symbol by the direction (reference should be made to Japanese Patent Application Laid-Open No. 2002-55757).

SUMMARY OF THE INVENTION

However, the method of implementing the detection of the direction of the force exerted is to additionally provide a plurality of pressure sensors in the marginal region around the axis of the key, and there is still room for improvement from the aspect of cost and from the aspect of readiness of implementation.

The present invention has been accomplished in order to solve the above problem, and an object of the present invention is to provide an input key and an input apparatus superior in cost and in readiness of implementation.

In order to achieve the above object, an input key according to the present invention is an input key which is assigned a plurality of information items to be inputted, the input key being assigned each of the information items to be inputted, according to a direction of a force exerted on the input key, the input key comprising: push detecting means for detecting a push on the input key; and direction detecting means for, when the push detecting means detects a push on the input key, detecting a strain occurring in the input key and thereby detecting a direction of a force exerted on the input key. Here the term "information items to be inputted" includes information generally assigned to each of input keys in the so-called full keyboard, e.g., information such as symbols, numbers, and marks, information of the linefeed code and control code, and so on.

A user of the input key according to the present invention exerts a force in a direction corresponding to an information item to be inputted, to push the input key. The input key experiences a strain occurring according to the direction of the force exerted by the user. When the input key is pushed, the push detecting means detects the push on the input key. When the push on the input key is detected, the direction detecting means detects the strain arising in the input key to detect the direction of the force exerted on the input key. In this manner, the input key according to the present invention is able to detect the push on the input key and detect the direction of the force exerted on the input key, without need for a plurality of additional pressure sensors. Therefore, it becomes feasible to specify an information item (an information item to be inputted by the user) according to the direction of the force detected, and to enter information. This permits implementation of the input key superior in cost and in readiness of implementation.

More specifically, the input key according to the present invention preferably has a configuration wherein a key top of the input key or a surrounding region thereof is formed of an elastically deformable member and wherein when the push detecting means detects a push on the input key, the direction detecting means detects a strain by means of a strain gage attached to the key top or to the surrounding region thereof, to detect a direction of a force exerted on the input key. Here the strain gage is a device for measuring strain of an object and, for example, there is a type making use of a resistance change according to the strain of the device which decreases the resistance when compressed or increases the resistance when stretched. The resistance herein refers to a value indicating an electrical resistance. The foregoing term "attached to the key top" covers embedding the strain gage in the key top. The term "attached to the surrounding region" embraces attaching the strain gage from the outside to the pertinent portion and embedding the strain gage in the pertinent portion.

More specifically, the input key according to the present invention preferably has a configuration wherein an elastically deformable member is provided in the vicinity of a connection between the input key and a support plate for supporting the input key, and wherein when the push detecting means detects a push on the input key, the direction detecting means detects a strain by means of a strain gage attached in the vicinity of the connection, to detect a direction of a force exerted on the input key. The input key also preferably has a configuration wherein the key top is comprised of an elastically deformable member and wherein when the push detecting means detects a push on the input key, the direction detecting means detects a strain by means of a strain gage attached to the key top, to detect a direction of a force exerted on the input key.

More specifically, the input key according to the present invention preferably has a configuration wherein the input key internally comprises a first projecting portion to be pushed together with a key top, and a second projecting portion set on a support plate for supporting the input key, wherein one of the first and second projecting portions is of a convex shape, the other projecting portion is of a concave shape, and the two projecting portions are loosely engageable with each other when the input key is pushed, wherein the projecting portion of the convex shape is formed of an elastically deformable member and a strain gage is attached to the projecting portion of the convex shape, and wherein when the push detecting means detects a push on the input key, the direction detecting means detects a strain by means of the strain gage attached to the projecting portion of the convex shape, to detect a direction of a force exerted on the input key.

The input key according to the present invention preferably has a configuration wherein the input key comprises portions which go into contact with each other inside the input key when the input key is pushed, and wherein either one or both of the portions to go into contact are formed of an embossed sheet. The embossed sheet is a sheet made of soft vinyl or the like and bulging in the center. When a force over a given level is applied to the bulging portion, the central bulging portion collapses at a stretch to get dented to the other side. When the force over the given level is removed, the central bulging portion dented to the other side returns into the original bulging state.

As the user pushes the input key, the input key is subject to a reaction force from the embossed sheet before the force of the push reaches the aforementioned given level. However, once the user applies the force over the given level, the embossed sheet collapses at a stretch to be dented, so as to decrease the reaction at a breath. This permits the user to sense the decrease of reaction at a fingertip during the push on the input key with a user's finger. As the user lifts the finger from the input key, the embossed sheet gradually returns from the dented state of the central bulging portion to the original shape to elevate the input key. When the embossed sheet returns up to a certain shape, the central bulging portion suddenly generates a strong restoring force to quickly increase the force to lift the input key.

As described above, the present invention can provide a touch of a push, so called a "click feel", when the user pushes the input key, and it permits the user to have a light keying feel.

In order to achieve the above object, an input apparatus according to the present invention is an input apparatus comprising at least one input key which is assigned a plurality of information items to be inputted, wherein the input key is assigned each of the information items to be inputted, according to a direction of a force exerted on the input key, the input apparatus comprising: push detecting means for detecting a push on the input key; direction detecting means for, when the push detecting means detects a push on the input key, detecting a strain occurring in the input key and thereby detecting a direction of a force exerted on the input key; and information determining means for determining an input information item, based on the direction detected by the direction detecting means.

The processing executed in the input apparatus according to the present invention will be described below. A user of the input apparatus selects an input key corresponding to an information item to be inputted, and exerts a force in a direction corresponding to the information item to be inputted, to push the input key. In the input key a strain occurs according to the direction of the force exerted by the user. When the input key is pushed, the push detecting means detects the push on the input key. When the push on the input key is detected, the direction detecting means detects the strain occurring in the input key and thereby detects the direction of the force exerted on the input key. Subsequently, the information determining means determines the input information item, based on the direction detected by the direction detecting means.

As described above, the present invention makes it feasible to detect the direction of the force exerted on the key and to input an information item according to the direction, without need for provision of additional pressure sensors or the like. It enables implementation of the input apparatus superior in cost and in readiness of implementation.

More specifically, the input apparatus according to the present invention preferably has a configuration wherein a key top of the input key or a surrounding region thereof is formed of an elastically deformable member and wherein when the push detecting means detects a push on the input key, the direction detecting means detects a strain by means of a strain gage attached to the key top or to the surrounding region thereof, to detect a direction of a force exerted on the input key.

More specifically, the input apparatus according to the present invention preferably has a configuration wherein an elastically deformable member is provided in the vicinity of a connection between the input key and a support plate for supporting the input key and wherein when the push detecting means detects a push on the input key, the direction detecting means detects a strain by means of a strain gage attached in the vicinity of the connection, to detect a direction of a force exerted on the input key.

More specifically, the input apparatus according to the present invention preferably has a configuration wherein the input key internally comprises a first projecting portion to be pushed together with a key top, and a second projecting portion set on a support plate for supporting the input key, wherein one of the first and second projecting portions is of a convex shape, the other projecting portion is of a concave shape, and the two projecting portions are loosely engageable with each other when the input key is pushed, wherein the projecting portion of the convex shape is formed of an elastically deformable member and a strain gage is attached to the projecting portion of the convex shape, and wherein when the push detecting means detects a push on the input key, the direction detecting means detects a strain by means of the strain gage attached to the projecting portion of the convex shape, to detect a direction of a force exerted on the input key.

The input apparatus according to the present invention preferably has a configuration wherein the input key comprises portions which go into contact with each other inside the input key when the input key is pushed, and wherein either one or both of the portions to go into contact are formed of an embossed sheet. In this case, as the user pushes the input key, the input key in the input apparatus is subject to a reaction force from the embossed sheet before the force of the push reaches the given level. However, once the user applies the force over the given level, the embossed sheet collapses at a stretch to be dented, so as to decrease the reaction at a breath. This permits the user to sense the decrease of reaction at a fingertip during the push on the input key with a user's finger. As the user lifts the finger from the input key, the embossed sheet gradually returns from the dented state of the central bulging portion to the original shape to elevate the input key. When the embossed sheet returns up to a certain shape, the central bulging portion suddenly generates a strong restoring force to quickly increase the force to lift the input key.

As described above, the present invention can provide a touch of a push, so called a "click feel", when the user pushes the input key in the input apparatus, and it permits the user to have a light keying feel.

Incidentally, in a desired configuration of the input apparatus according to the present invention, the input apparatus further comprises controlling means for, during a push operation on an input key, outputting assignment information of a plurality of input information elements to the input key at a time of the operation, to an external display device and for making the display device highlight information of an input candidate corresponding to the push operation at the time, out of the plurality of input information elements.

This achieves the following three effects. Namely, (1) in a case where the assignment of the plurality of input information elements to the input key is changed according to frequencies of use or the like, the user can check the up-to-date assignment information on the external display device during a push operation on the input key. (2) For example, in a case where the input mode is switched from an input mode of Japanese hiragana writing symbols to an alphabet input mode, it is feasible to feed back to the user the assignment information of input information about the input mode after the switch, which cannot be readily displayed by only the display on the key top. Furthermore, (3) the user can also check the information as an input candidate corresponding to a push operation at the time of the operation (information selected at the time). The feedback function of up-to-date assignment information as described above can dramatically improve easiness and certainty of user operation.

The present invention makes it feasible to detect a push on the input key and to detect the direction of the force exerted on the input key, without need for a plurality of additional pressure sensors. Therefore, it becomes feasible to specify an information item (an information item to be inputted by the user) according to the direction of the force detected, and to enter an information item. This enables implementation of the input key and input apparatus superior in cost and in readiness of implementation.

BRIEF DESCRIPTION OF THE DRAWINGS

FIG. 10 is a decision table for making a decision on a direction of a force exerted on an input key, in the first embodiment.

FIG. 11 is a tally table indicating an initial state in the first embodiment, and a tally table indicating a state in which a direction of a force is detected.

FIG. 12 is an example of a symbol conversion table in the first embodiment.

FIG. 16 is a decision table for making a decision on a direction of a force exerted on an input key, in another example in the first embodiment.

FIG. 20 is a decision table (first decision table) for making a decision on a direction of a force in each strain gage, in the second embodiment.

FIG. 21 is a decision table (second decision table) for making a decision on a direction of a force exerted on an input key, in the second embodiment.

FIG. 24 is an illustration of configurations of strain gages in other examples in the second embodiment.

FIG. 25 is a decision table for forces in the left and right directions in another example in the second embodiment and a decision table for forces in the up and down directions (which together constitute a first decision table).

FIG. 26 is a decision table (second decision table) for making a decision on a direction of a force exerted on an input key, in another example in the second embodiment.

FIG. 28 is a decision table (second decision table) for making a decision on a direction of a force exerted on an input key, in another example in the second embodiment.

FIG. 35 is an illustration showing an example of shape of an upper electrode and an example of shape of a lower electrode in the third embodiment.

FIG. 39 is a table showing an example of assignment of Japanese hiragana writing symbols and marks to each of keys.

FIG. 40 is a table showing an example of assignment of English alphabet symbols and marks to each of keys.

FIG. 42 is a table showing an example of assignment of Chinese 声母(consonants) and Chinese 韻母(vowels) to each of keys.

FIG. 43 is a table showing an example of assignment of Korean symbols to each of keys.

FIG. 48 is a drawing showing a cross section along X-X line in FIG. 47 and a cross section where a strain occurs due to a force in a predetermined direction in a key top.

FIG. 49 is a table for making a decision on a direction of a force in the fourth embodiment.

DESCRIPTION OF THE PREFERRED EMBODIMENTS

Various embodiments of the present invention will be described below with reference to the drawings.

First Embodiment

Figure 1:
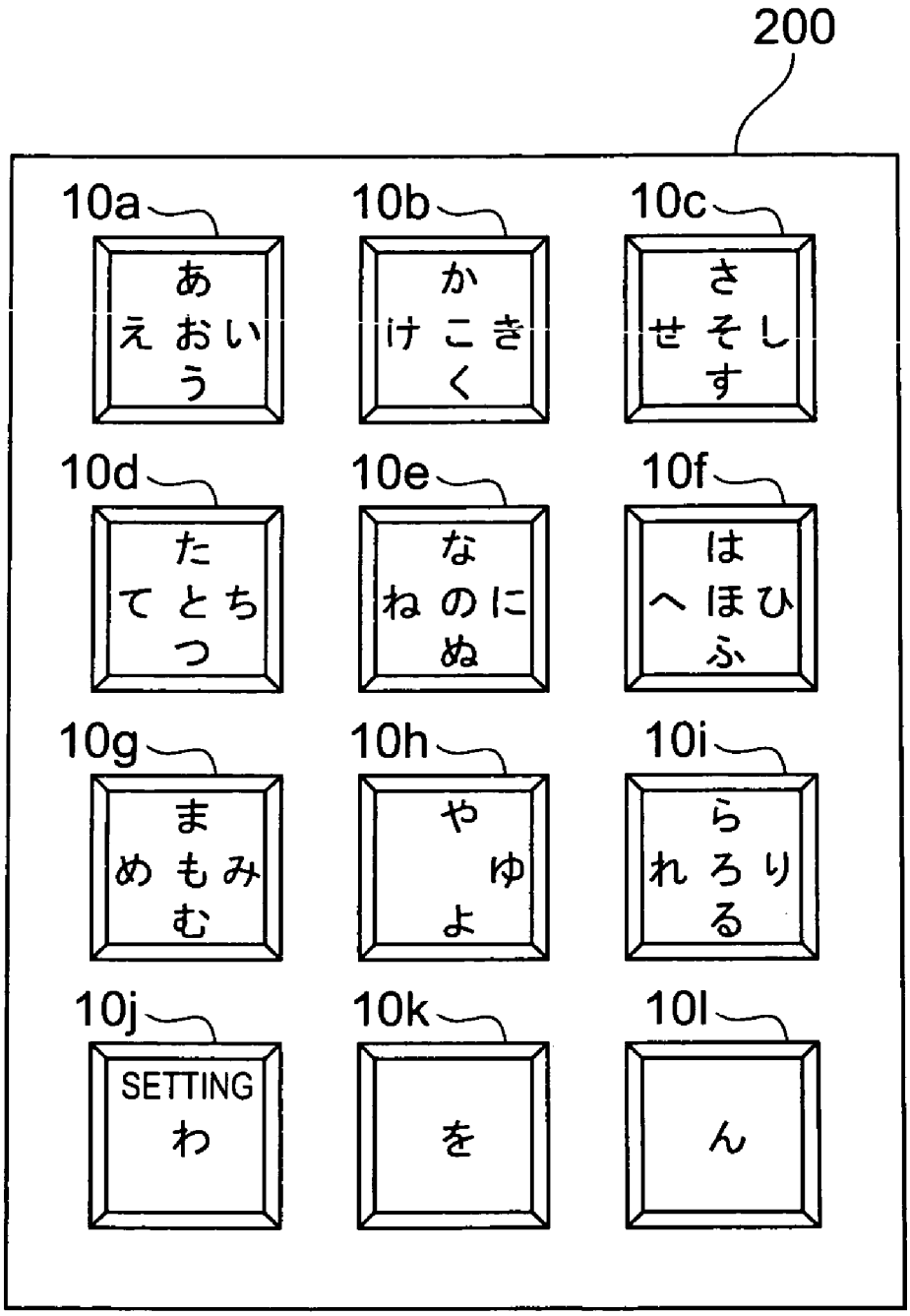
FIG. 1 is an illustration showing an exterior configuration of an input apparatus in an embodiment of the present invention.

FIG. 1 shows an exterior configuration of input apparatus 200 in the first embodiment. As shown in FIG. 1, the input apparatus 200 is provided with twelve input keys 10 (generically used to refer to input keys 10*a*-101) of 4 vertical and 3 horizontal. Here the input apparatus 200 is used in various portable terminals such as mobile communication terminals typified by cell phones, PDAs (Personal Digital Assistants), and so on.

Each input key 10 is assigned one or two or more symbols according to a direction or directions of force exerted on the input key 10. In the description hereinafter, the hiragana writing symbols being one of the Japanese symbol formats will be used as an example of symbols to be inputted through the input keys 10. The Japanese hiragana writing symbols can be classified into a plurality of subgroups, and each subgroup consists of five symbols. These subgroups include the "あ line" group consisting of five symbols (あ, い, う, え, お) corresponding to five basic vowels, the "か line" group consisting of five symbols か, き, く, け,こcorresponding to the foregoing five vowels coupled with a specific consonant "K", the "さ line" group consisting of five symbols (さ, し, す, せ, そ) corresponding to the foregoing five vowels coupled with a specific consonant "S", the "た line" group consisting of five symbols (た, ち, つ, て, と) corresponding to the foregoing five vowels coupled with a specific consonant "T", and so on.

For example, the input key 10*a* is assigned a symbol group of the "あ line group" according to directions of force as follows: "あ" in "up"; "い" in "right"; "う" in "down"; "え" in "left"; "お" in "center". In addition, as shown in FIG. 1, indications to display the assignment are provided on the surface of the key top of the input key 10*a*. Similarly, the input key 10*b* is assigned a symbol group of the "か line group", and the input key 10*c* a symbol group of the "さ line group".

Figure 3:
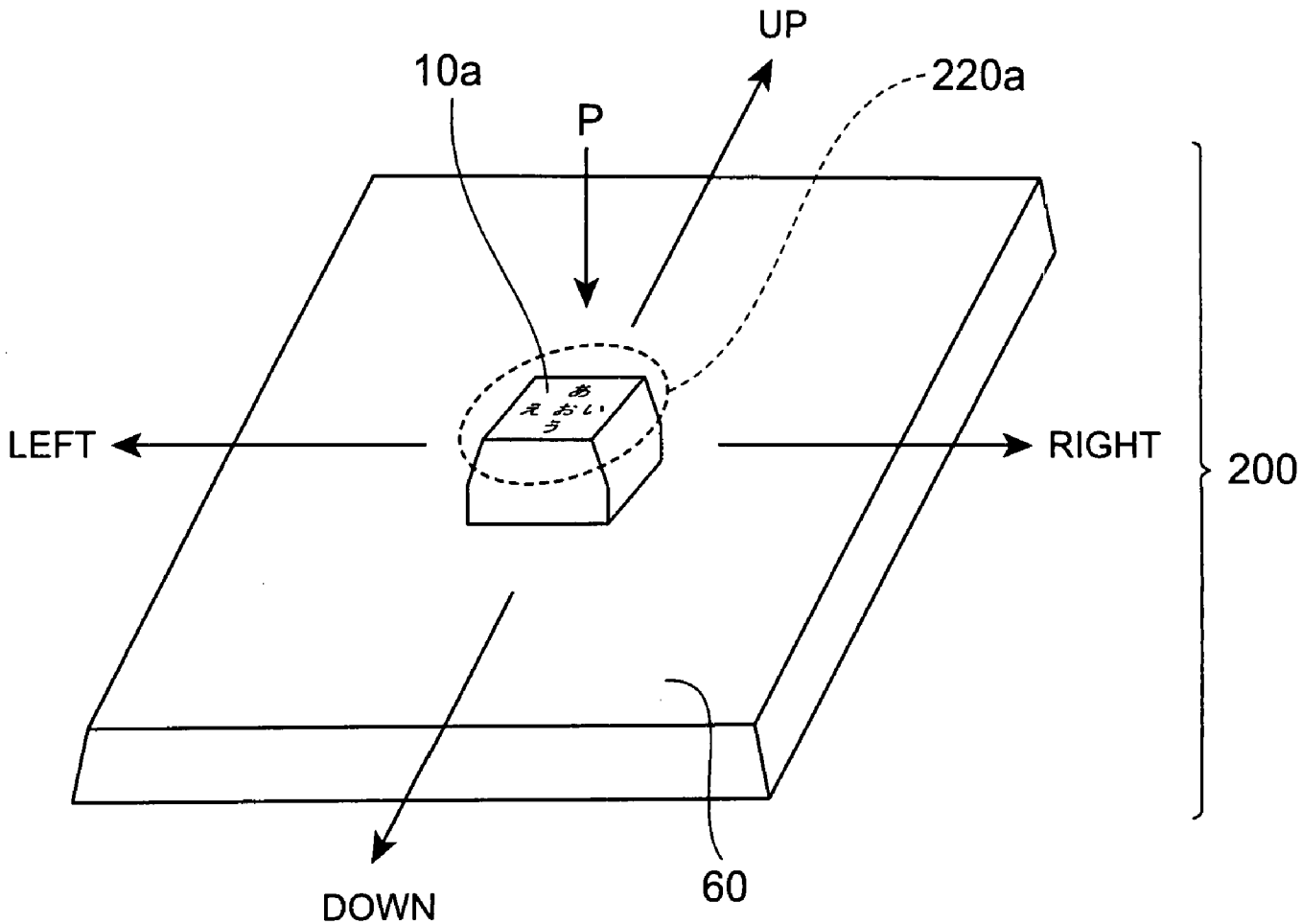
FIG. 3 is an illustration for explaining "directions" in an embodiment.

The "directions" in the present embodiment will be described below with reference to FIG. 3. As shown in FIG. 3, the input key 10*a* is placed on a support plate 60. A "direction" in the present embodiment indicates "up", "down", "left", "right", or "center" with respect to the plane of support plate 60. The "center" refers to a state in which during a push on the input key 10 no force is applied in either direction, i.e., a state in which a force vertical to the support plate 60 is exerted.

Figure 2:
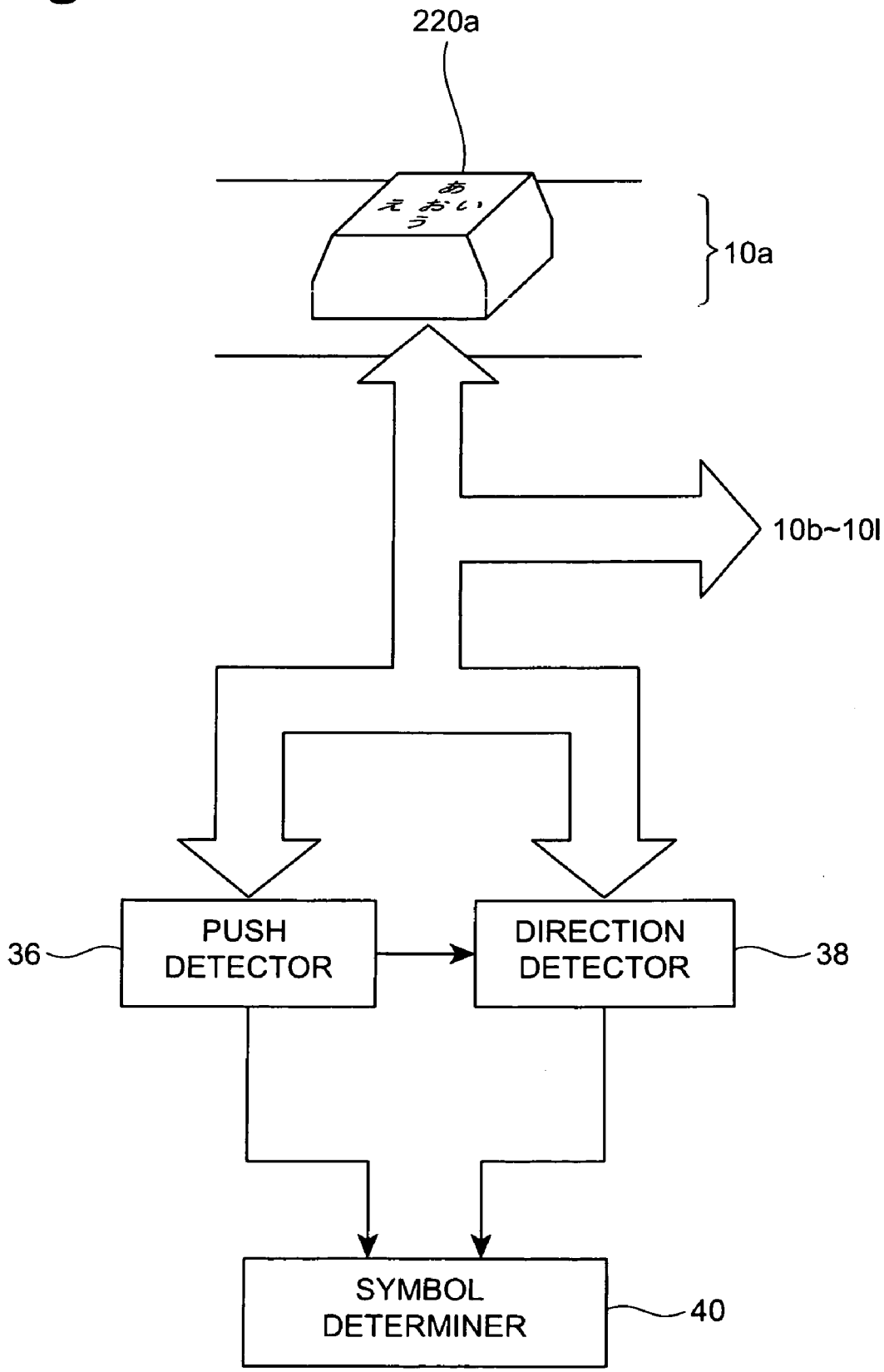
FIG. 2 is a functional block diagram of an input apparatus in an embodiment.

FIG. 2 shows a functional configuration of the input apparatus 200. As shown in FIG. 2, the input apparatus 200 has the input keys 10 (only the input key 10*a* illustrated), a push detector 36, a direction detector 38, and a symbol determiner 40. The push detector 36 corresponds to the push detecting means according to the present invention, the direction detector 38 to the direction detecting means according to the present invention, and the symbol determiner 40 to the information determining means according to the present invention. The upper part of the input key 10*a* (the part surrounded by a dotted line in FIG. 3) is called a key top 220*a* and is a portion on which a force is exerted during a push on the input key 10*a*. The push detector 36, direction detector 38, and symbol determiner 40 each may be constructed separately from the input keys 10, or may be constructed integrally therewith.

An input key 10 is pushed when a user of the input apparatus enters a symbol. Namely, for input of a symbol in the "あ line group", the user exerts a force on the key top 220*a* of the input key 10*a* to push the key. When exerting the force on the key top 220*a* of the input key 10*a*, the user applies the force in one direction of "up", "down", "left", "right", or "center", whereby a symbol can be specified.

The push detector 36 detects a push on an input key 10. The direction detector 38 has a decision table shown in FIG. 10 and detects a direction of a force exerted on the input key 10. The decision table, as shown in FIG. 10, stores conditions based on strain of the input key 10 detected (conditions corresponding to directions of force exerted on the input key 10) (the details of which will be described later). The symbol determiner 40 has a tally table shown in FIG. 11 and a symbol conversion table shown in FIG. 12, and determines an input symbol, based on the direction detected. The tally table, as shown in FIG. 11, stores a name of an input key 10 pushed and detection counts corresponding to the directions of force exerted on the input key 10. For example, FIG. 11(*b*) shows that the input key 10*a* was pushed, the central direction was detected 60 times, the right direction was detected 90 times, and the other directions were not detected. The symbol conversion table, as shown in FIG. 12, stores symbols to be inputted, corresponding to an input key 10 and to the directions of force on the input key 10. For example, FIG. 12 shows that "お" corresponds to the center direction of the input key 10*a*, "あ" to the up direction, "い" to the right direction, "う" to the down direction, and "え" to the left direction. This symbol conversion table may also be arranged so as to permit the user to freely set the corresponding symbols. The contents of the symbol conversion table may be arranged to be automatically updated according to statistical results of user's symbol input. For example, a symbol at a high user's input frequency may be automatically assigned to a direction or an input key 10 easier to push.

Figure 8:
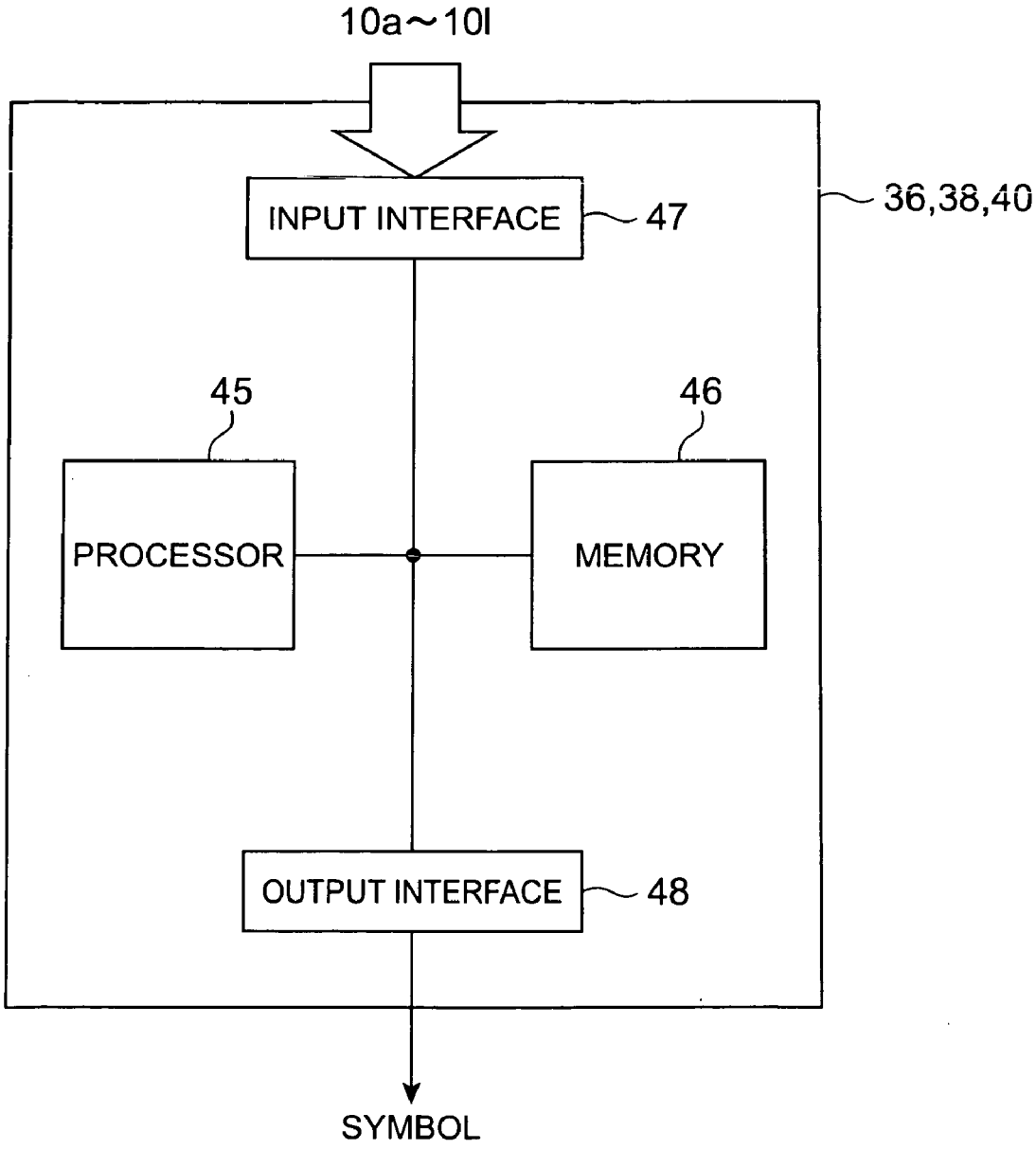
FIG. 8 is a functional block diagram of a symbol determiner.

Here the push detector 36, direction detector 38, and symbol determiner 40 are constructed as an integral device, as shown in FIG. 8, provided with a processor 45, a program executed by the processor 45, a memory 46 storing various tables and various data, an input interface 47 for receiving various signals, and an output interface 48 for outputting a symbol as a determination result to the outside.

Figure 4:
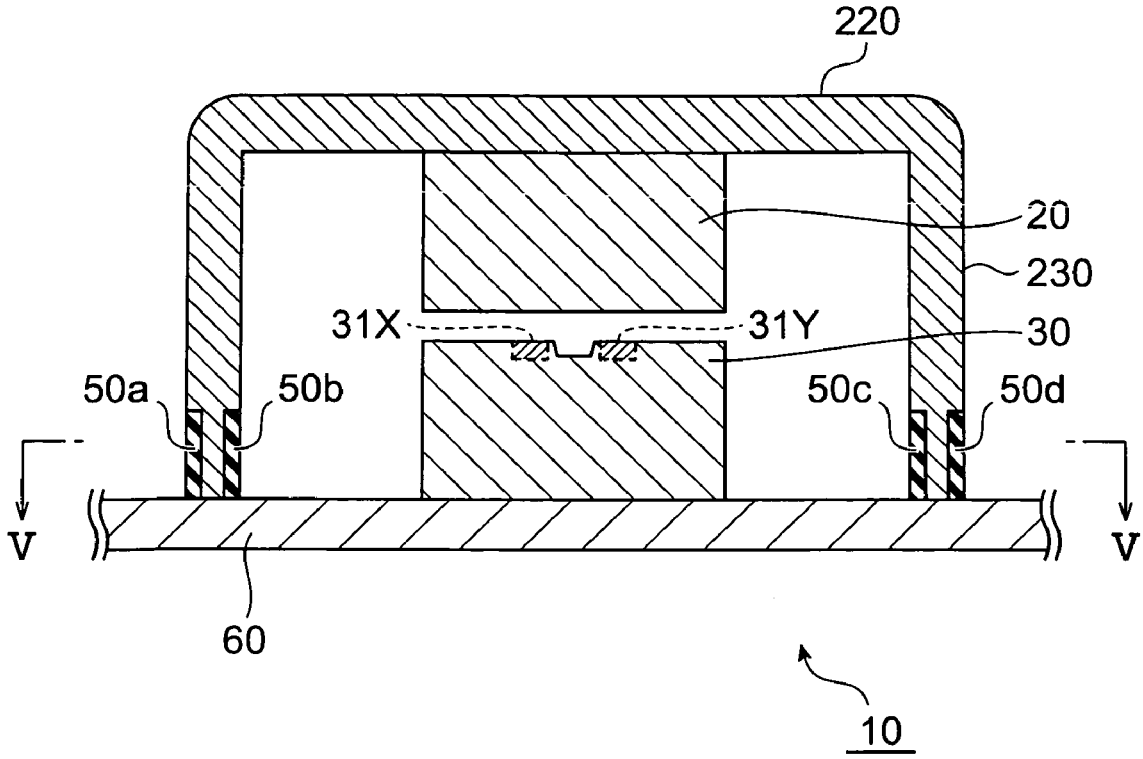
FIG. 4 is a vertical sectional view of an input key in the first embodiment.
Figure 5:
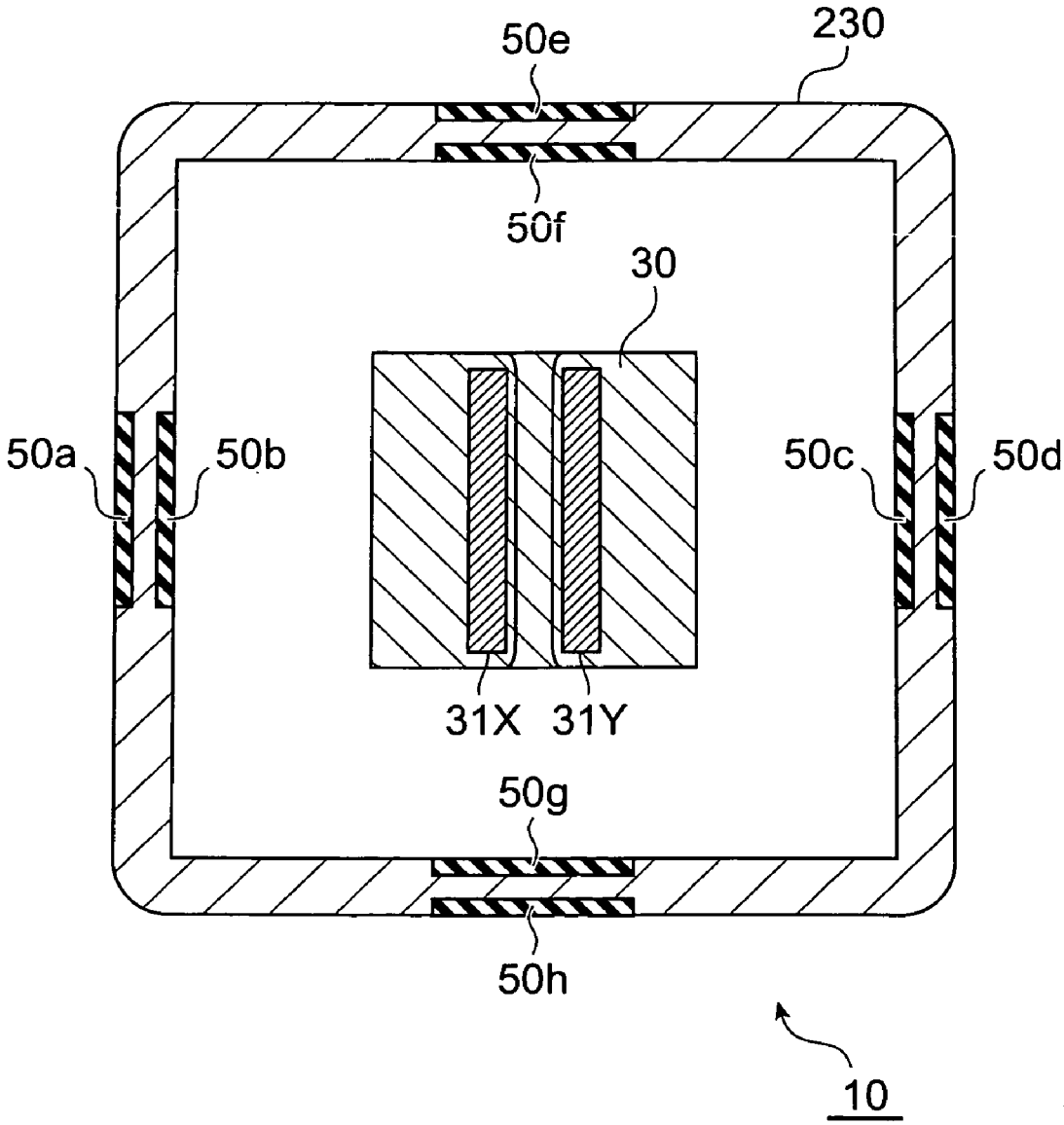
FIG. 5 is a V-V cross-sectional view of the input key shown in FIG. 4 in the first embodiment.
Figure 6:
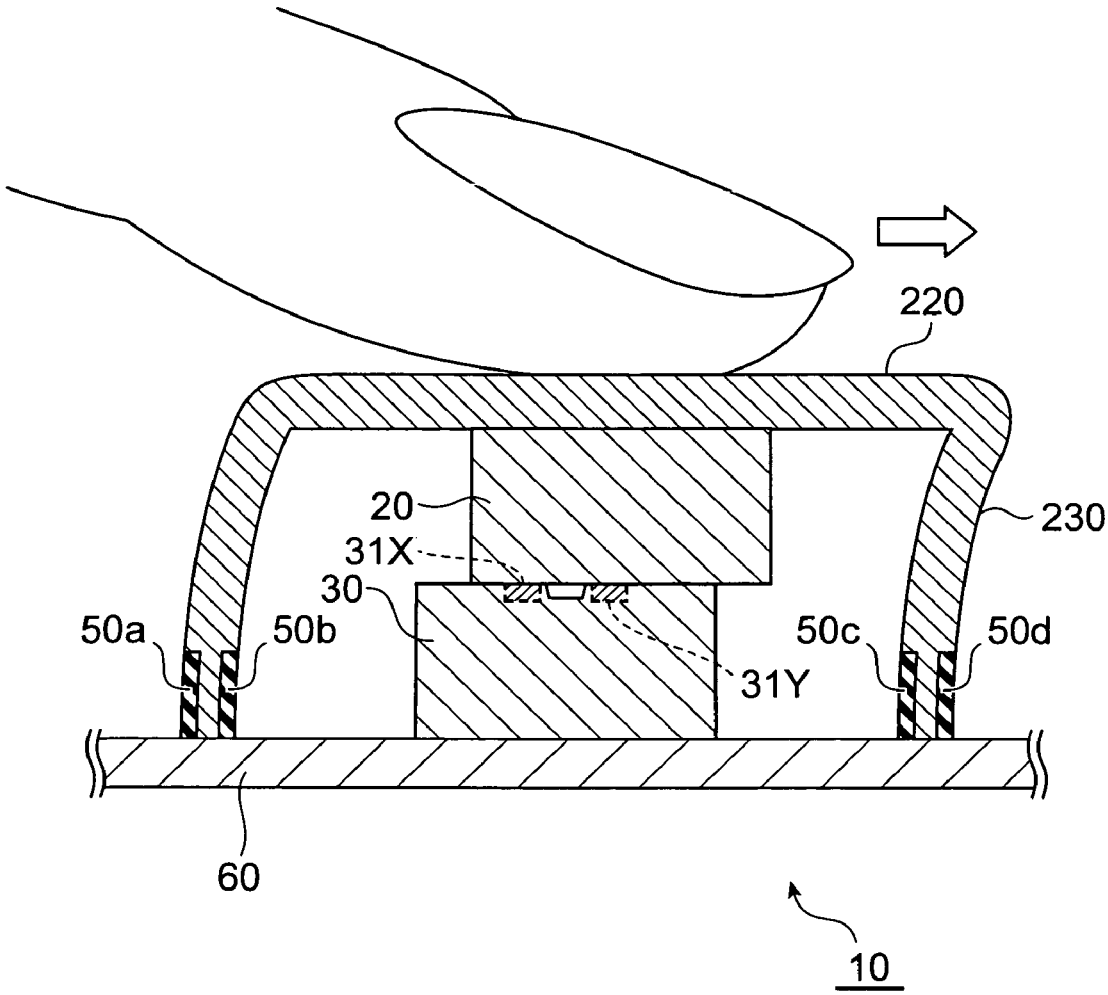
FIG. 6 is an illustration showing an example of a state during a push on an input key in the first embodiment.
Figure 7:
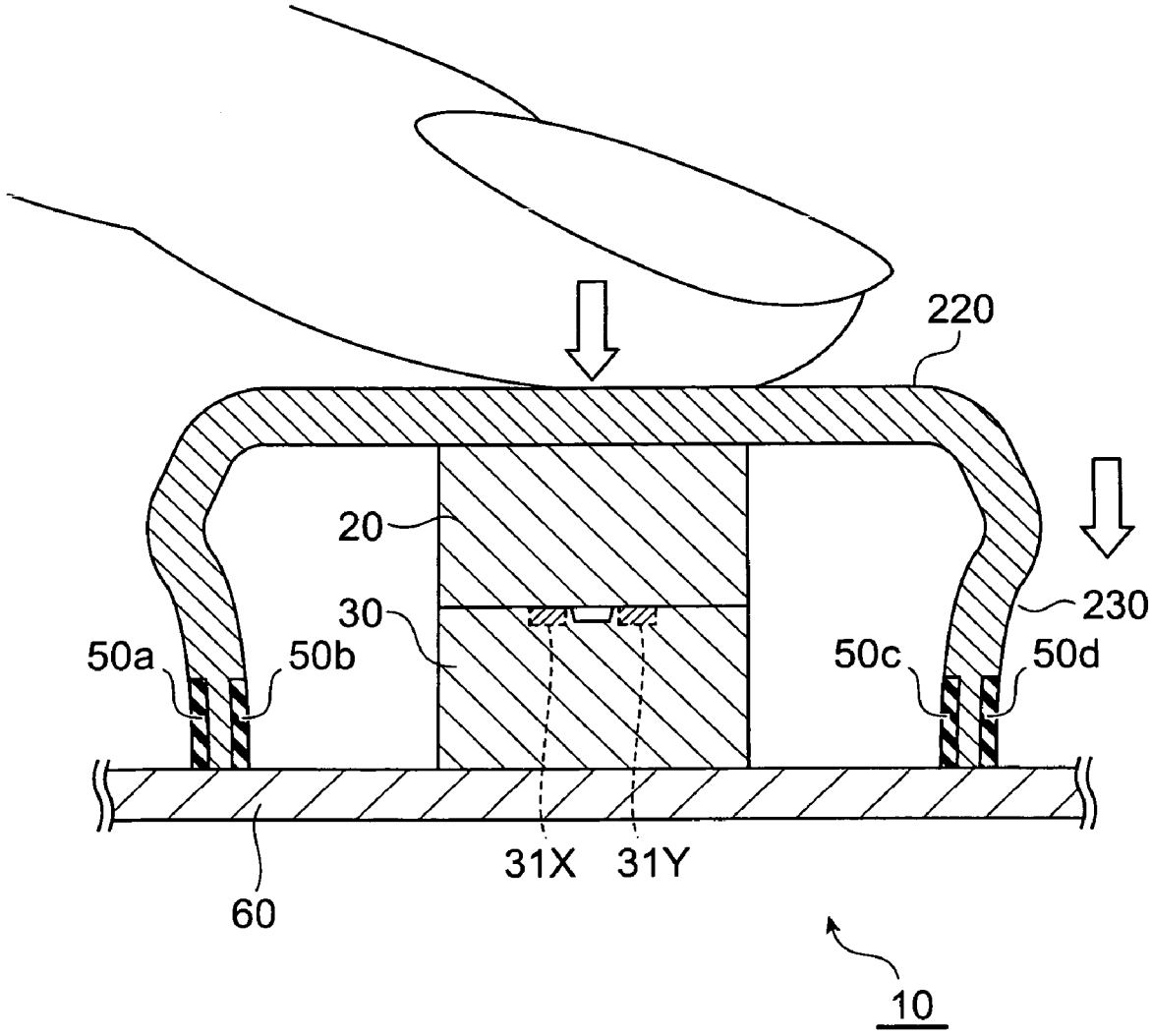
FIG. 7 is an illustration showing an example of a state during a push on an input key in the first embodiment.

FIG. 4 shows a cross section of an input key 10. As shown in FIG. 4, the input key 10 is comprised of an upper electrode 20, a lower electrode 30, a key top 220, and a key skirt 230. The upper electrode 20 is located so as to be stuck to the key top 220, inside the input key 10. The lower electrode 30 is located inside the input key 10 and on the support plate 60 and located with a clearance below the upper electrode 20. The upper electrode 20 is made of a conductor such as metal, and two electrically conducting pieces 31X, 31Y are embedded in a top surface of the lower electrode 30. When the input key 10 is pushed to bring the upper electrode 20 into contact with each of the two conducting pieces 31X, 31Y, the two conducting pieces 31X, 31Y go into an electrically conducting state through the upper electrode 20. This causes the push detector 36 to detect the conducting state, thereby detecting a push on the input key 10. The key skirt 230 is connected vertically to the support plate 60. As shown in FIG. 4 and in FIG. 5 which is a sectional view of the input key 10 shown in FIG. 4, a strain gage 50 (generically used to refer to strain gages 50*a*-50*h*) is attached to each of the interior side and exterior side of the key skirt 230 in the input key 10. The strain gages 50 to be used are, for example, those of the type making use of the resistance change due to strain of the device as described above. The key top 220 and the key skirt 230 are integral with each other and are made of an elastically deformable, flexible material, e.g., synthetic rubber, soft plastic, or soft vinyl. Since the key top 220 and key skirt 230 are made of such material, when a force is exerted vertically on the input key 10, the key skirt 230 is deformed as shown in FIGS. 6 and 7 to bring the upper electrode 20 into contact with the lower electrode 30. When the force is eliminated, the key skirt 230 returns to the original state without contact between the upper electrode 20 and the lower electrode 30, as shown in FIG. 4, by its elastic force.

The processing executed in the input apparatus 200 of the present embodiment will be described below mainly with reference to the flowchart of FIG. 9.

When the user pushes an input key 10, the processing is started. The user pushes an input key 10 to which a symbol to be inputted is assigned, while exerting a force in a direction corresponding to the symbol to be inputted. For example, where the user desires to input the symbol of "ゝ", the user pushes the input key 10*a* assigned "ゝ", while exerting a force in the right direction corresponding to "ゝ". Here, how to exert the force in the direction corresponding to the symbol to be inputted may be a method of exerting the force in the direction at the same time as the push, or a method of once pushing the key vertically and thereafter exerting the force in the direction while maintaining the push state.

With the push, as shown in FIGS. 6 and 7, the upper electrode 20 goes into contact with the lower electrode 30. When the upper electrode 20 goes into contact with each of the two conducting pieces 31X, 31Y, the two conducting pieces 31X, 31Y go into the conducting state through the upper electrode 20. The push detector 36 detects the conducting state to detect a start of the push on the input key 10 (S11).

When the start of the push is detected, as shown in FIG. 11(*a*), the symbol determiner 40 stores the name of the input key 10 in the tally table and resets the values of detection counts, i.e., turns the values of detection counts corresponding to all the directions, to "0". Since the user pushes the input key 10*a* herein, "key 10a" is stored in the name of the input key (S12).

Subsequently, the direction detector 38 detects the direction of the force exerted on the input key 10 (S13). Specifically, the detection is carried out as follows. First, measured are resistances of the strain gages 50 attached to the key skirt 230. The resistance of each strain gage 50 decreases when compressed, or increases when stretched. Where the force is exerted in the right direction, as shown in FIG. 6, the strain gages 50*a*, 50*c* are stretched, while the strain gages 50*b*, 50*d* are compressed. This results in increasing the resistances of the strain gages 50*a*, 50*c* and decreasing the resistances of the strain gages 50*b*, 50*d*. Namely, a large "difference" is made between the resistances of strain gages 50 adjacent through a wall surface of the key skirt 230. By detecting this "difference", therefore, it is feasible to determine in which direction the force is exerted. It is determined that a force is exerted in one of the directions if the above "difference" is larger than a certain value. The decision table shown in FIG. 10 shows the determination criteria and the direction detector 38 refers to the decision table to make a decision on a direction of a force exerted on the input key 10. In the decision table, A to H represent the resistances of the respective strain gages 50*a*-50*h*, and $\alpha_1$ and $\alpha_2$ predetermined positive values indicating the above "difference". Furthermore, β is a predetermined positive value used to determine whether there is no force applied perpendicularly to a direction in question; for example, for making a decision on a force in the left direction, it is used to determine whether there is no force applied in the directions vertical to the left direction, i.e., in the up and down directions of the input key. For example, the direction detector 38 determines that "the direction of the force exerted on the input key is the right direction" if the following conditions are met as shown in FIG. 10.

$$A \geqq B+\alpha_1$$

$$C \geqq D+\alpha_2$$

$$|E-F| \leqq \beta$$

$$|G-H| \leqq \beta$$

Here the condition that the absolute value of the difference between the resistances E and F is not more than β needs to exist in order to eliminate a case where the force is exerted in an oblique direction such as "upper right". By adding this condition, it becomes feasible to determine that the force is exerted in the "right" direction only if the force is applied generally in the direction of "just right". The condition that the absolute value of the difference between the resistances G and H is not more than β is also provided for a like reason. The directions of "up", "down", and "left" are also determined in a manner similar to the above. When the force is exerted only in the vertical direction, as shown in FIG. 7, to satisfy neither of the conditions in the decision table, the direction is determined to be "center".

Subsequently, the symbol determiner 40 updates the tally table, based on the direction of the force thus determined. The symbol determiner 40 adds "1" to the decided direction of the force in the tally table shown in FIG. 11 (S14).

Subsequently, the push detector 36 detects an end of the push on the input key 10. The detection of the end of the push on the input key 10 is carried out by determining whether the upper electrode 20 left the lower electrode 30 to establish a non-conducting state (S15). When the push on the input key 10 is not ended, the processes of S13 to S15 are again carried out. It is preferable to make the foregoing determination on whether the non-conducting state is established, at very short time intervals on the millisecond time scale or the like.

When the push on the input key 10 ends, the symbol determiner 40 determines a direction corresponding to a maximum value of the detection counts from the tally table to which the above value was added (S16). Namely, the symbol determiner 40 determines a direction at the highest frequency of force exerted, out of the directions of force exerted on the input key 10. The direction can be deemed as a direction in which the user exerted the force with the intension. For example, where at the time of S16 the tally table is in the state shown in FIG. 11(*b*), the direction determined will be the right direction.

Subsequently, the symbol determiner 40 determines an input symbol from the name of the key stored in the tally table and the direction thus determined, based on the symbol conversion table (S17). For example, where the name of the key stored in the tally table is "key 10*a*" as shown in FIG. 11(*b*) and where the direction is the right direction, the symbol determiner 40 determines that the input symbol is "ゝ", based on the symbol conversion table corresponding to the key 10*a* as shown in FIG. 12. Then the symbol determiner 40 outputs the symbol thus determined (S18).

As described above, the input key 10 of the present embodiment is able to detect a push on the input key 10 and to detect a direction of a force exerted on the input key 10, without need for a plurality of additional pressure sensors. Therefore, it becomes feasible to specify an information item (an information item to be inputted by the user) according to the direction of the force detected, and to enter an information item. Likewise, the input apparatus 200 of the present embodiment is able to detect a direction of a force exerted on the input key 10 and to enter an information item according to the direction, without provision of additional pressure sensors or the like. It is thus feasible to realize the input key or the input apparatus superior in cost and in readiness of implementation.

Figure 13:
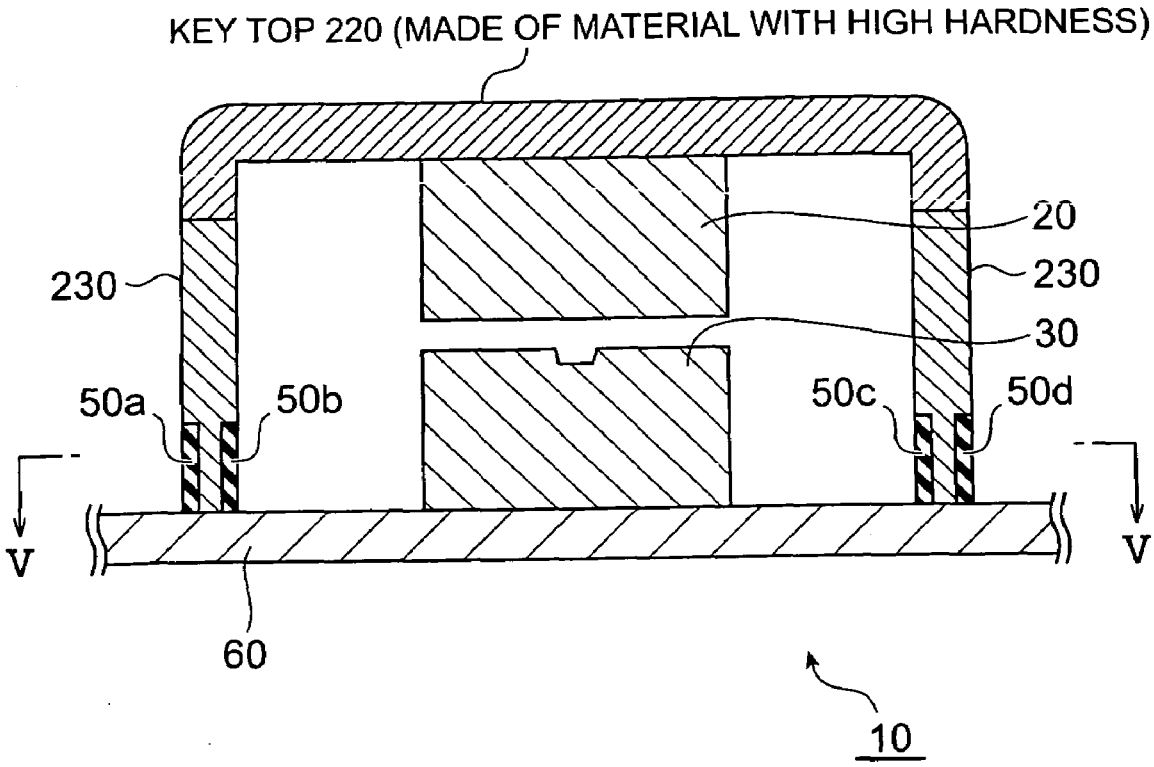
FIG. 13 is a vertical sectional view of an input key in another example in the first embodiment.

In the present embodiment, the key top 220 itself was made of the elastically deformable, flexible material, but the part of the key top 220 may also be made of a material with some hardness, as shown in FIG. 13. The material with some hardness is preferably, for example, hard plastic, metal, or the like.

The above configuration eliminates an uncomfortable feel due to a dent of the key top part during a push on the input key 10, permits the user to more clearly sense a touch of movement in the up, down, left, and right directions through deformation of only the peripheral part, and thus presents a favorable touch for the user.

Figure 14:
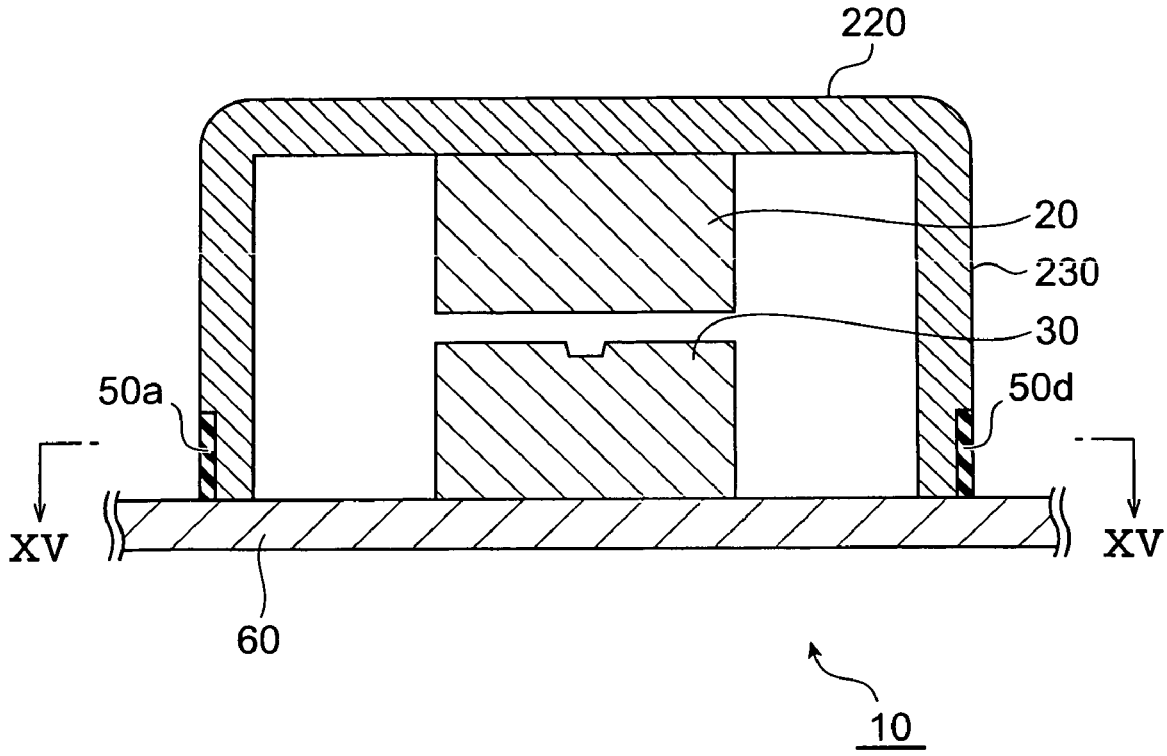
FIG. 14 is a vertical sectional view of an input key in another example in the first embodiment.
Figure 15:
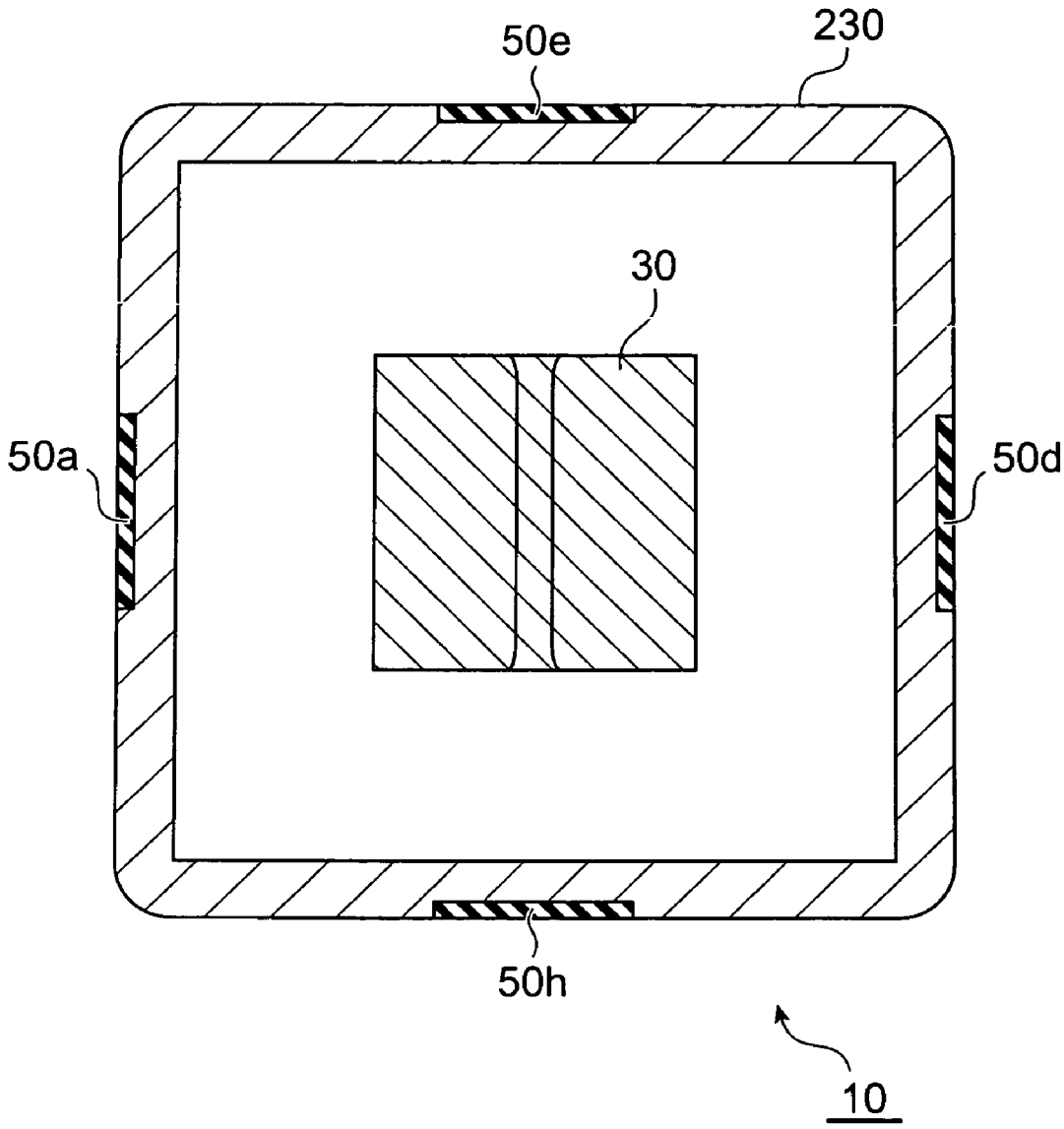
FIG. 15 is an XV-XV sectional view of an input key shown in FIG. 14 in the first embodiment.

In the present embodiment, the strain gages 50 were attached to the exterior surface and to the interior surface of the key skirt 230 in each direction, but the strain gages 50 may be attached only to the exterior surface of the key skirt 230, as shown in FIGS. 14 and 15. In this case, for example, the decision on the direction of leftward or rightward force can be made by use of resistances of the strain gages 50 attached to the left and right exterior surfaces of the key skirt 230 in each direction, based on the decision table shown in FIG. 16. Here a in FIG. 16 is a predetermined positive value indicating a difference, as in the above.

The strain gages 50 may also be attached only to the interior surface, instead of the exterior surface of the key skirt 230. In that case, the condition for the left direction and the condition for the right direction in the decision table are reversed, and the condition for the up direction and the condition for the down direction are reversed.

Figure 36:
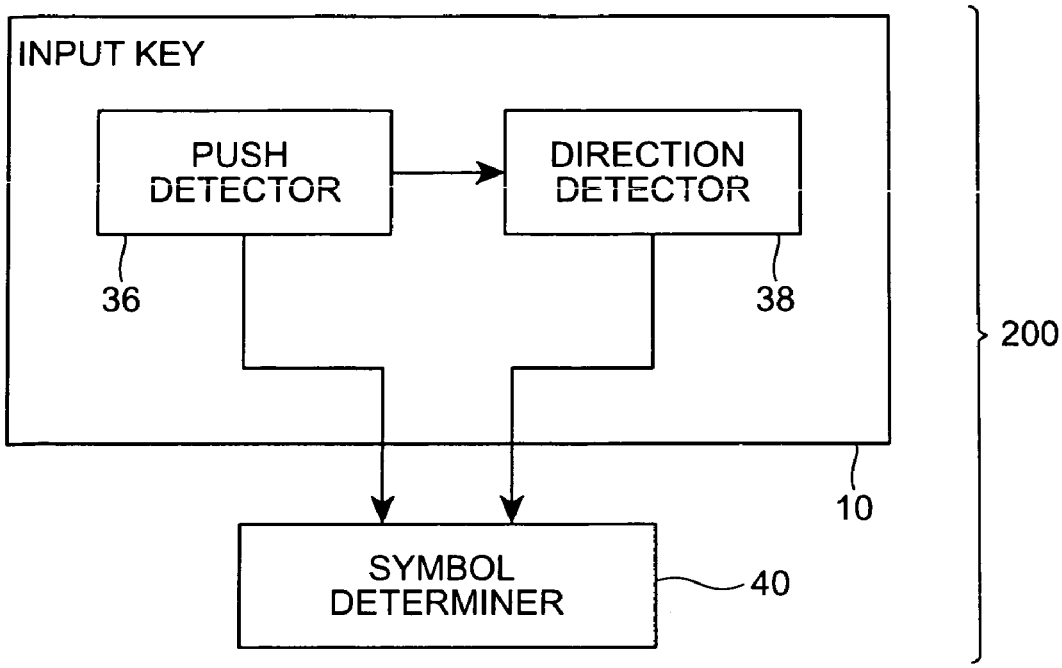
FIG. 36 is an example of a functional block diagram of an input apparatus in an embodiment.

In the present embodiment the push detector 36 and the direction detector 38 are constructed separately from the input key 10, but they may also be constructed integrally with the input key 10 as shown in FIG. 36.

Incidentally, the above embodiment showed the input example of the Japanese hiragana writing symbols with FIG. 1, and in practice Japanese input requires input of several types of symbols including the katakana writing symbols, numerals, and alphabet, in addition to the hiragana writing symbols. In connection therewith, the following will describe an example of input of several types of symbols, using an extra key (hereinafter referred to as a "symbol type designation key") provided for designating a type of a symbol to be inputted.

Figure 37:
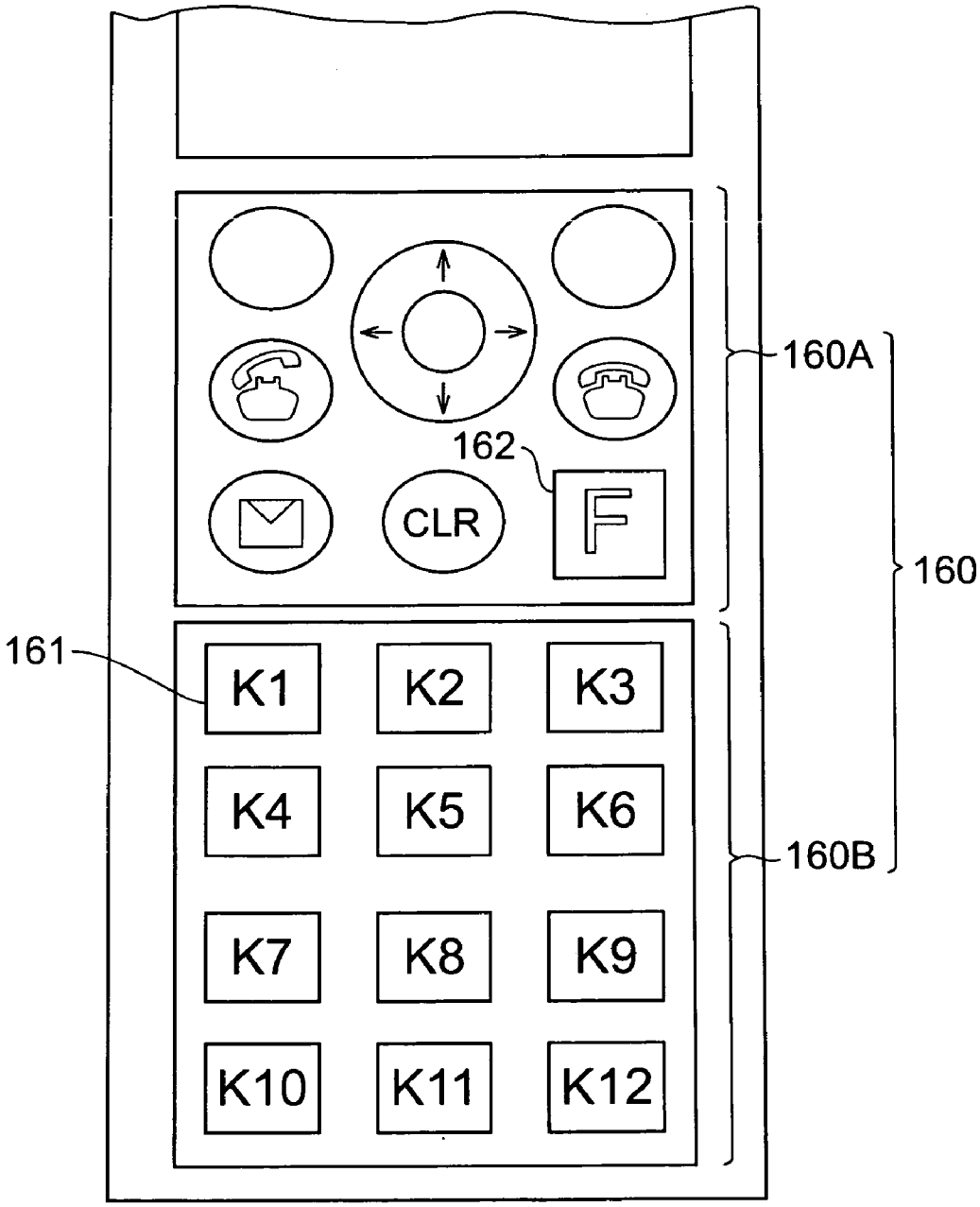
FIG. 37 is a configuration diagram of an input part of a cell phone in an example of implementing input of plural types of symbols.

For example, as shown in FIG. 37, an input portion 160 of a cell phone is composed of a special key arrangement part 160A and a symbol input key arrangement part 160B, wherein the symbol input key arrangement part 160B includes twelve (three horizontal x four vertical) keys 161 and wherein the special key arrangement part 160A includes a symbol type designation key (hereinafter abbreviated as an "F key") 162.

Figure 38:
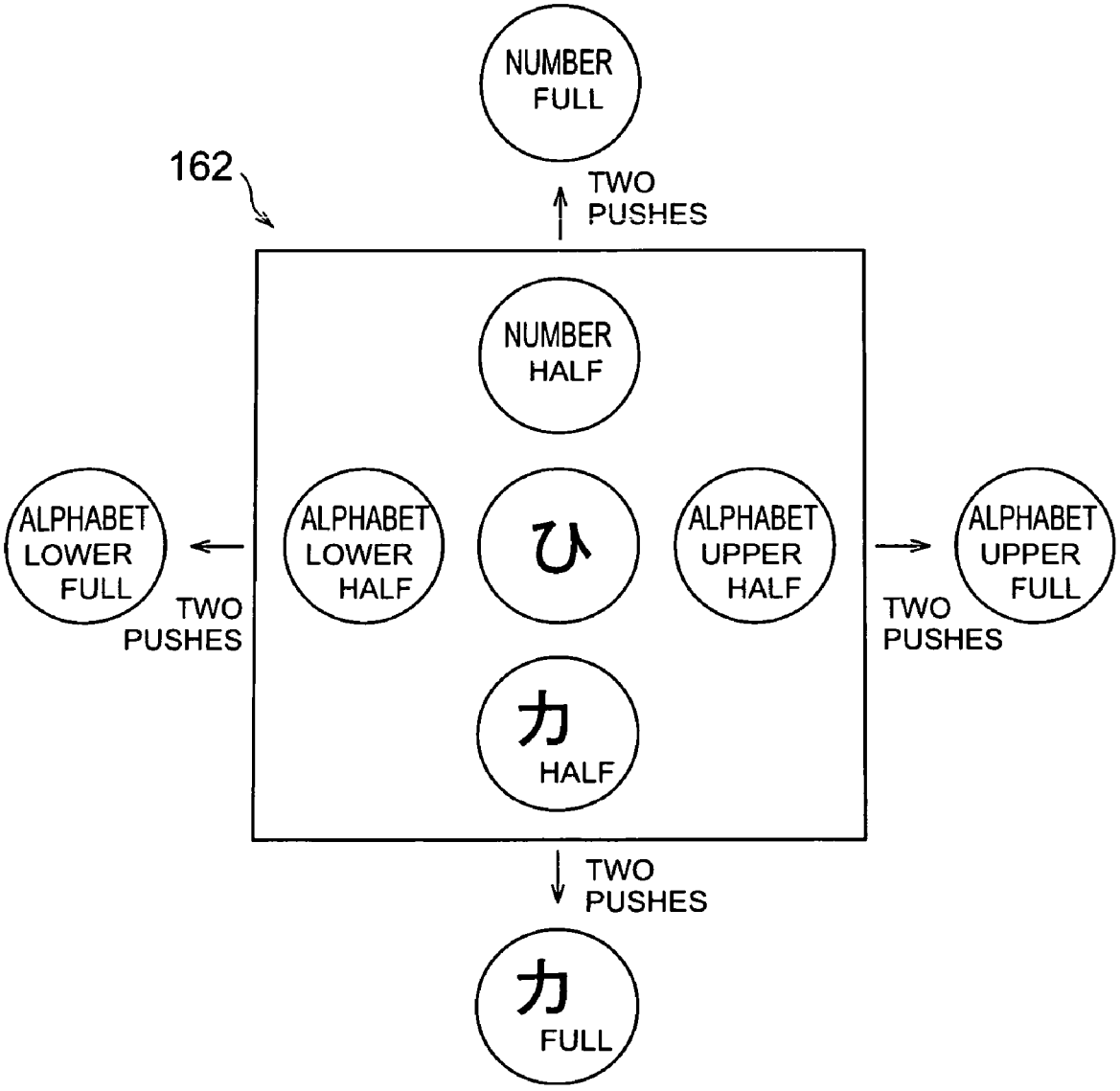
FIG. 38 is an illustration for explaining designation of symbol types assigned to an F key.

As shown in FIG. 38, the F key 162 is assigned symbol type designations for respective moving directions as follows. The F key 162 is so arranged that symbol types tending to be frequently inputted can be designated by one operation (a movement of a finger), for example, center (still)-hiragana writing symbols, upward-half-width (one byte) numbers, leftward-half-width English lower-case symbols, downward-half-width katakana writing symbols, and rightward-half-width English upper-case symbols. The F key 162 is so configured that the symbol types other than the above can be designated by two operations. Namely, as shown in the space outside the frame of the F key 162 in FIG. 38, the symbol type of full-width (two bytes) numbers can be designated by two continuous upward movements of a finger, and the symbol type of full-width English lower-case symbols by two continuous leftward movements of a finger. The symbol type of full-width katakana writing symbols can be designated by two continuous downward movements of a finger, and the symbol type of full-width English upper-case symbols by two continuous rightward movements of a finger. In this manner two continuous movements of a finger in a specific direction enable designation of a symbol type different from that designated by only one movement of a finger in that specific direction, thus providing expandability about designation of symbol types.

The symbol assignment to the twelve keys 161 in the symbol input key arrangement part 160B is, for example in the case of the hiragana writing symbols, that as shown in FIG. 39. Since the hiragana writing symbols can be classified under the symbol groups each consisting of five symbols like "five symbols in the あline group", "five symbols in the かline group" . . . , as described previously, one symbol group (five symbols) can be assigned to one key 161. As shown in the table format of FIG. 39, the key K1 is assigned the "five symbols (あ, い, う, え, お) in the あline group", and the key K2 the "five symbols (か, き, く, け, こ) in the かline group". In this manner, one symbol group (five symbols) can be assigned to one key 161.

As shown in the assignment to the keys K10, K11 in the table of FIG. 39, frequently input marks (cho-on (long sound), kuten (Japanese period), touten (Japanese comma), etc.) other than the hiragana writing symbols can also be assigned.

Furthermore, the special symbols among the hiragana writing symbols include an example of display of symbols in size smaller than usual (e.g., "や", "っ", etc.), an example of display of voiced consonants (e.g., "が", "ざ", etc.), and an example of display of p-sounds (e.g., "ぱ", "ぴ", etc.). In addition, the hiragana writing symbols are often converted into katakana small symbols or katakana large symbols. Therefore, as shown in the assignment to the key K12 in the table of FIG. 39, it is also possible to assign the above-described functions of "conversion to small symbol", "conversion to voiced consonant", "conversion to p-sound", "conversion to katakana small symbol", and "conversion to katakana large symbol".

The above described the key assignment about the input of the Japanese hiragana writing symbols, but the present invention, which facilitates the input operation by assigning a plurality of symbols, marks, or functions to one key as shown in FIG. 39 and decreasing the number of key input operations, can also be applied to input of symbols in the other languages. Examples of application of the present invention to input of English, German, French, Chinese, and Korean symbols will be described below.

Figure 41:
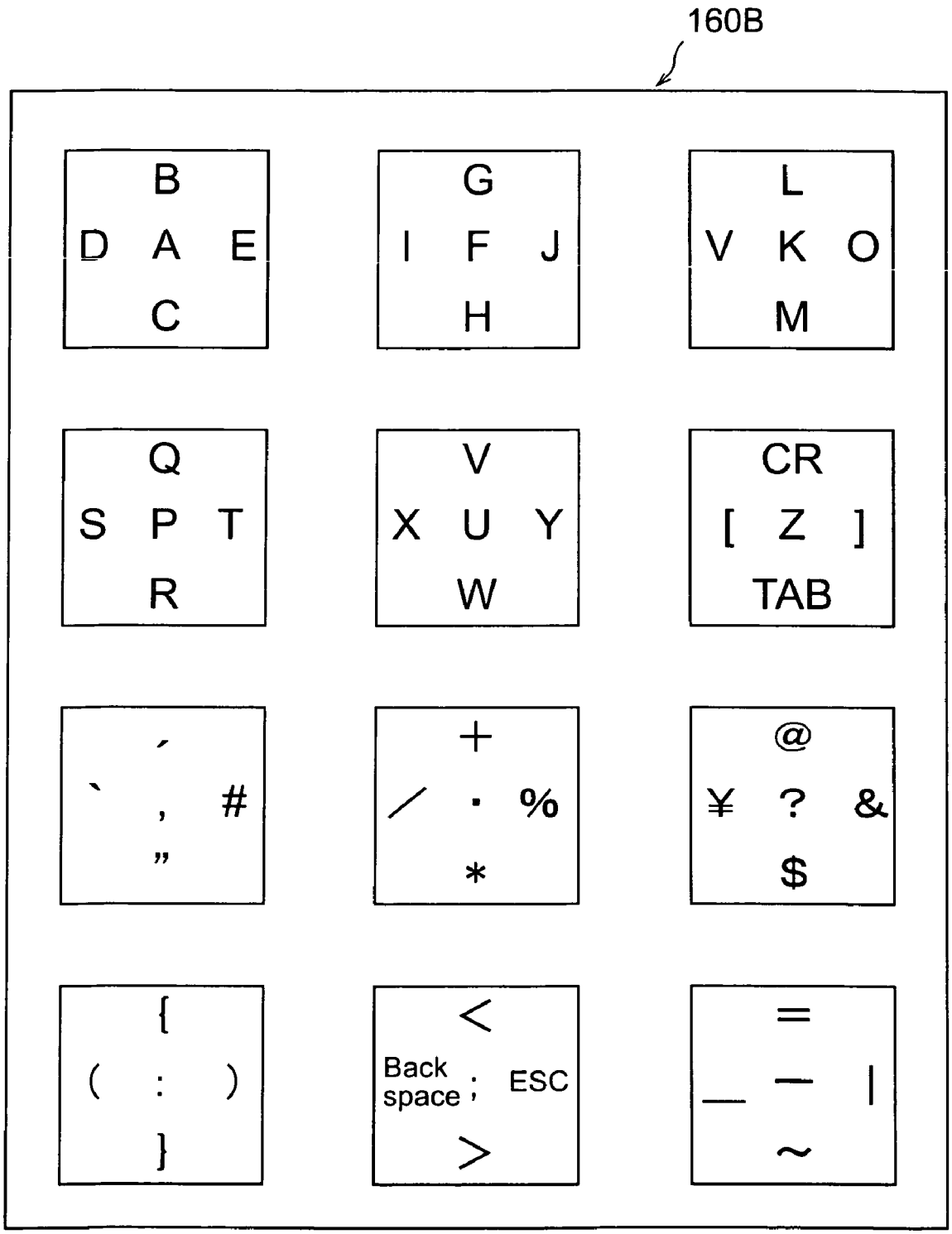
FIG. 41 is an illustration showing a state in which alphabet letters and marks are assigned to each of keys on the basis of the assignment table of FIG. 40.

First, an example of application of the present invention to input of English symbols will be described. The English symbols (alphabet) include twenty six symbols in total, and are not grouped into symbol groups each consisting of five symbols, different from the Japanese hiragana writing symbols. Thus a conceivable method is to assign five symbols to each key in order from the top of the alphabet (A, B, C, . . . ), as shown in FIG. 40. In that case, the keys K1-K6 are enough to assign all the twenty six symbols, and many keys are still left. Therefore, many marks (e.g., return (CR), tab (TAB), . . . ) can be assigned to the remaining keys. The assignment table of FIG. 40 shows the assignment of the alphabet and marks to the keys (K1-K12), and FIG. 41 shows an example of actual assignment to each of the keys (K1-K12) in the symbol input key arrangement part 160B (cf. FIG. 37), based on the assignment table.

This enables one to input the symbol types equivalent to those through the full keyboard by one operation (a movement of a finger). Namely, the function equivalent to that of the full keyboard can be substantialized by the smaller number of input keys, and the input of symbols can be implemented by the reduced number of input operations, thus dramatically improving the efficiency of input operation.

A switchover among four symbol types of half-width English lower-case symbols, full-width English lower-case symbols, half-width English upper-case symbols, and full-width English upper-case symbols can be implemented by manipulating the F key 162 in FIG. 37. FIG. 38 shows the F key 162 in Japanese, and, since the English does not include the hiragana and katakana writing symbols, all the four symbol types can be assigned to the four directions of the F key 162 in FIG. 37, whereby one can designate a desired English symbol type by one operation on the F key 162.

The assignment of the alphabet and marks to each of the keys (K1-K12) in FIG. 40 can also be applied to input of English symbols in Japanese.

Next, an example of application of the present invention to input of the German symbols will be described. For input of the German symbols, it is necessary to input peculiar symbols such as symbols with the Umlaut mark (e.g., Ä, Ö, Ü, etc.) and β (Eszett), in addition to the input of the same alphabet as in English.

Thus the peculiar symbols as described above can replace the mark-assigned portions in the assignment table of FIG. 40, whereby the input of the symbol types equivalent to those through the full keyboard can be implemented by one operation (a movement of a finger). Namely, the function equivalent to that of the full keyboard can be substantialized by the smaller number of input keys, and the input of symbols can be implemented by the reduced number of input operations, thus dramatically improving the efficiency of input operation.

Next, an example of application of the present invention to input of the French symbols will be described. In order to input the French symbols, it is necessary to input the peculiar symbols as described below, in addition to the input of the same alphabet as in English. Namely, the peculiar symbols are é (accent aigu), à, è, ù (accent grave), â, î, û, ê, ô (accent circonflexe), ï, ü, ë (tréma), ç (cédille), œ (o e composé), and so on.

Thus the peculiar symbols as described above can replace the mark-assigned portions in the assignment table of FIG. 40, whereby the input of the symbol types equivalent to those through the full keyboard can be implemented by one operation (a movement of a finger), as in the case of the English input. Namely, the function equivalent to that of the full keyboard can be substantialized by the smaller number of input keys, and the symbol input can be implemented by the reduced number of input operations, thus dramatically improving the efficiency of input operation.

Next, an example of application of the present invention to input of the Chinese symbols will be described. A common Chinese symbol input method is the pin-yin input system of inputting an alphabet sequence (pin-yin) equivalent to the reading (pronunciation) of a symbol as an input object. This pin-yin input system is classified under two input methods of complete pin input and bi-pin input.

The complete pin input uses the English keyboard as it is, and pin-yin is inputted in each symbol unit according to the alphabetical notation on the keyboard. For example, where Chinese "今天晴" corresponding to "今日は晴れです (sunny today)" is inputted, an alphabet sequence "JIN" corresponding to the reading (pronunciation) of "今", an alphabet sequence "TIAN" corresponding to the reading (pronunciation) of "天", and an alphabet sequence "QING" corresponding to the reading (pronunciation) of "晴" are inputted in order according to the alphabet notation on the English keyboard. Therefore, the key assignment as shown in FIG. 40 and FIG. 41 can be adopted for the complete pin input, as in the case of the aforementioned example of application of the present invention to the English symbol input, and it becomes feasible to input the symbol types equivalent to those through the full keyboard by one operation (a movement of a finger), thus dramatically improving the efficiency of symbol input operation.

On the other hand, the bi-pin input is a way of inputting each symbol by separate use of Chinese 声母(head consonant) and 韻母(subsequent vowel component). Here the "声母" means a consonant at the head of a syllable, and "韻母" means a portion except for the head consonant in the syllable, the "韻母" always containing a vowel. In the bi-pin input, symbols are inputted by switching in an order of 声母(consonant) ⟶韻母(vowel component) ⟶声母(consonant) ⟶韻母(vowel component). Namely, this input method involves a device of reducing the number of typing operations on the keyboard by the separate use of 声母and 韻母and, once one learns the keyboard arrangement of the bi-pin input, he or she can input symbols by the smaller number of input operations than by the aforementioned complete pin input, so as to realize efficient symbol input.

The bi-pin input of this type requires two key assignments, 声母(head consonant) key assignment for input of 声母and 韻母(subsequent vowel component) key assignment for input of 韻母. The present invention can be applied to these 声母key assignment and 韻母key assignment. For example, FIG. 42(*a*) shows an example of the 声母key assignment. The key K1 is assigned five 声母(consonants) (b, c, ch, f, g), and which consonant was inputted can be determined by a moving direction of a finger on the key K1. The keys K2-K5 can also be assigned consonants in similar fashion. FIG. 42(*b*) shows an example of the 韻母key assignment. The key K1 is assigned five 韻母(vowel components) (a, ai, an, ang, ao), and which vowel component was inputted can be determined by a moving direction of a finger on the key K1. The keys K2-K7 can also be assigned vowel components in similar fashion.

In the bi-pin input, symbols are inputted by switching in the order of consonant →vowel component →consonant →vowel component as described above, and the key assignment is arranged to become the consonant key assignment of FIG. 42(*a*) upon input of a consonant and to become the vowel component key assignment of FIG. 42(*b*) upon input of a vowel component.

In the bi-pin input, as described above, the consonant and vowel component key assignments as shown in FIG. 42 enable one to input the symbol types equivalent to those through the full keyboard by one operation (a movement of a finger). Namely, the function equivalent to that of the full keyboard can be substantialized by the smaller number of input keys, and the symbol input can be implemented by the reduced number of input operations, thereby dramatically improving the efficiency of input operation.

In the Chinese input, the marks (e.g., !, ?, etc.) other than the symbols are also often inputted. It is thus desirable to assign the various types of marks to the remaining portions in the key assignments of FIG. 42, just as in the case of the assignment example of the English symbols in FIG. 40, thereby achieving efficient input as to input of marks as well.

Lastly, an example of application of the present invention to input of the Korean symbols will be described. Each Korean symbol (hangul symbol) is composed of a combination of a consonant with a vowel. Therefore, for symbol input, it is necessary to input a consonant-indicating part and a vowel-indicating part for each symbol. There are nineteen consonants and twenty one vowels, and forty portions indicating the total of these forty sounds are assigned to keys. An example of this assignment is presented in FIG. 43. In FIG. 43, portions surrounded by thick line 163 represent the nineteen portions indicating the consonants, and the other twenty one portions correspond to the portions indicating the vowels.

Since the keys can be assigned the forty portions indicating the respective sounds, the forty sounds in total including the nineteen consonants and twenty one vowels, as described above, it becomes feasible to input the symbol types equivalent to those through the full keyboard by one operation (a movement of a finger). Namely, the function equivalent to that of the full keyboard can be substantialized by the smaller number of input keys, and the symbol input can be implemented by the reduced number of input operations, thereby dramatically improving the efficiency of input operation.

In the Korean input, the marks (e.g., !, ?, etc.) other than the symbols are also often inputted. It is thus desirable to assign the various types of marks to the remaining keys (keys K9-K12) in the key assignment of FIG. 43, just as in the case of the assignment example of the English symbols in FIG. 40, thereby achieving efficient input as to the input of marks as well.

As described above, the present invention is applicable to input of symbols in various languages, and achieves the excellent effects of substantializing the function equivalent to that of the full keyboard by the smaller number of input keys and enabling the symbol input by the reduced number of input operations, thereby dramatically improving the efficiency of input operation.

Second Embodiment

Figure 17:
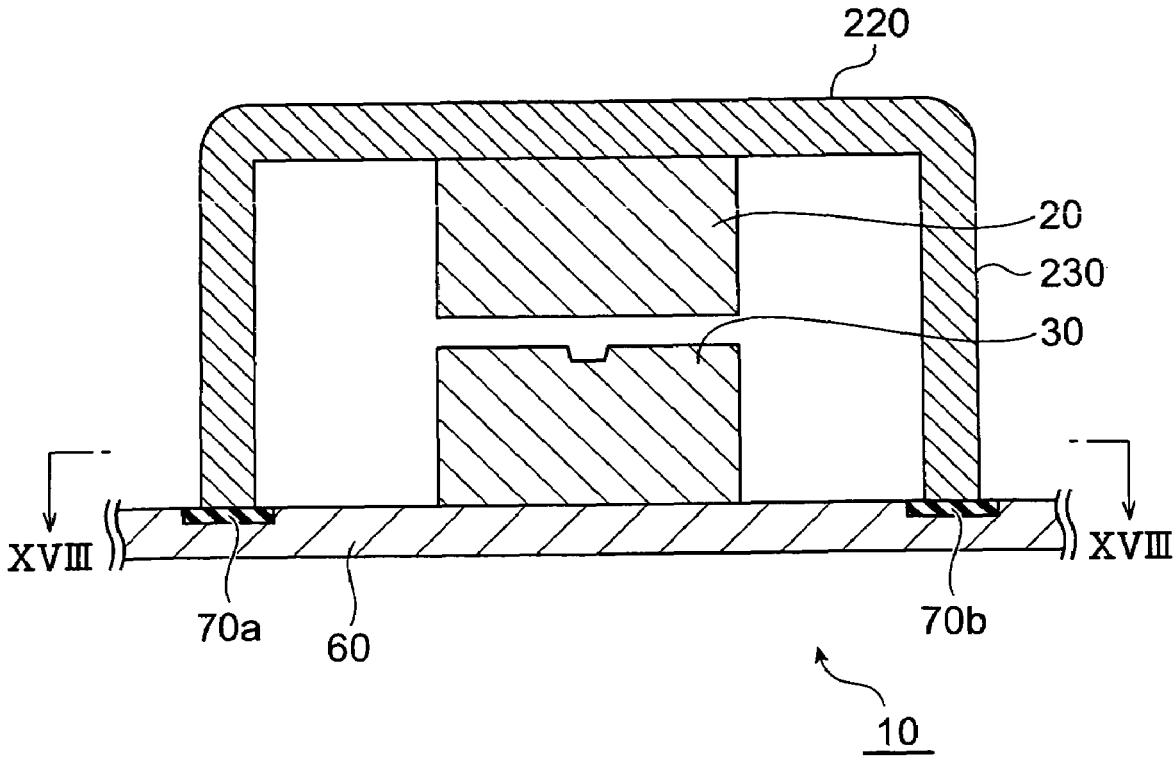
FIG. 17 is a vertical sectional view of an input key in the second embodiment.
Figure 18:
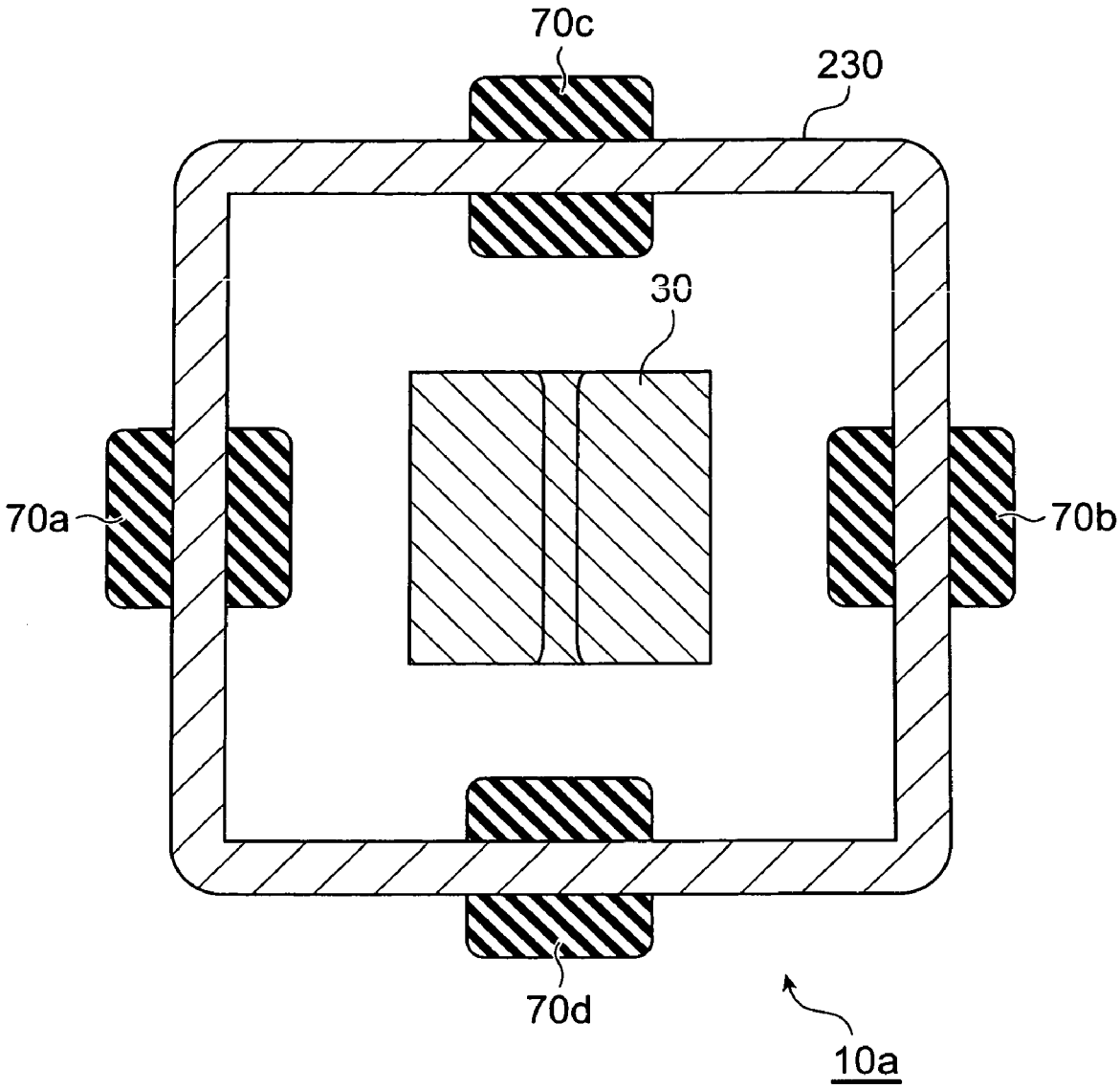
FIG. 18 is an XVIII-XVIII sectional view of an input key shown in FIG. 17 in the second embodiment.

FIG. 17 shows a cross section of an input key 10 in the second embodiment. FIG. 18 shows an XVIII-XVIII cross section of the input key 10 shown in FIG. 17. The exterior configuration and functional configuration of input apparatus 200 are similar to those in the first embodiment.

As shown in FIGS. 17 and 18, strain gages 70. (generically used to refer to strain gages 70*a*-70*d*) are attached to a connection of the support plate 60 to the input key 10, i.e., to the lower part of the key skirt 230. The other structure of the input key 10 is similar to that in the first embodiment. Since in the above configuration a force exerted on the input key 10 is transferred to the strain gages 70, a direction of the force exerted can be determined by measuring resistances of the strain gages 70.

Figure 19:
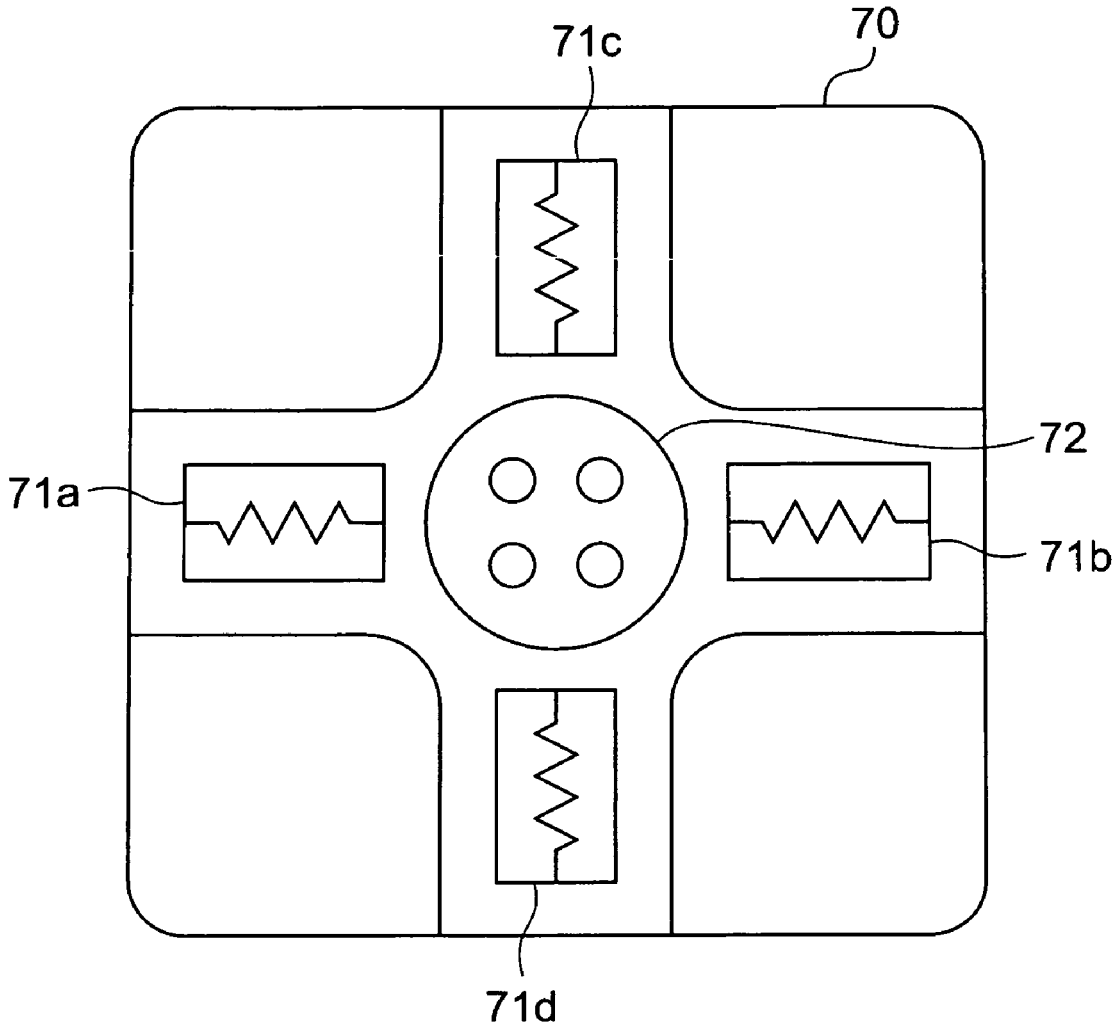
FIG. 19 is an illustration of a configuration of a strain gage in the second embodiment.

Each strain gage 70 used in the present embodiment is comprised of four strain gage pieces 71 (generically used to refer to strain gage pieces 71*a*-71*d*) provided in the directions of up, down, left, and right, and a key skirt mount portion 72, as shown in FIG. 19. The direction detector 38 measures resistances of these four strain gage pieces 71 and thus can decompose a force exerted, into vertical and horizontal components and detect the vertical and horizontal components.

Figure 9:
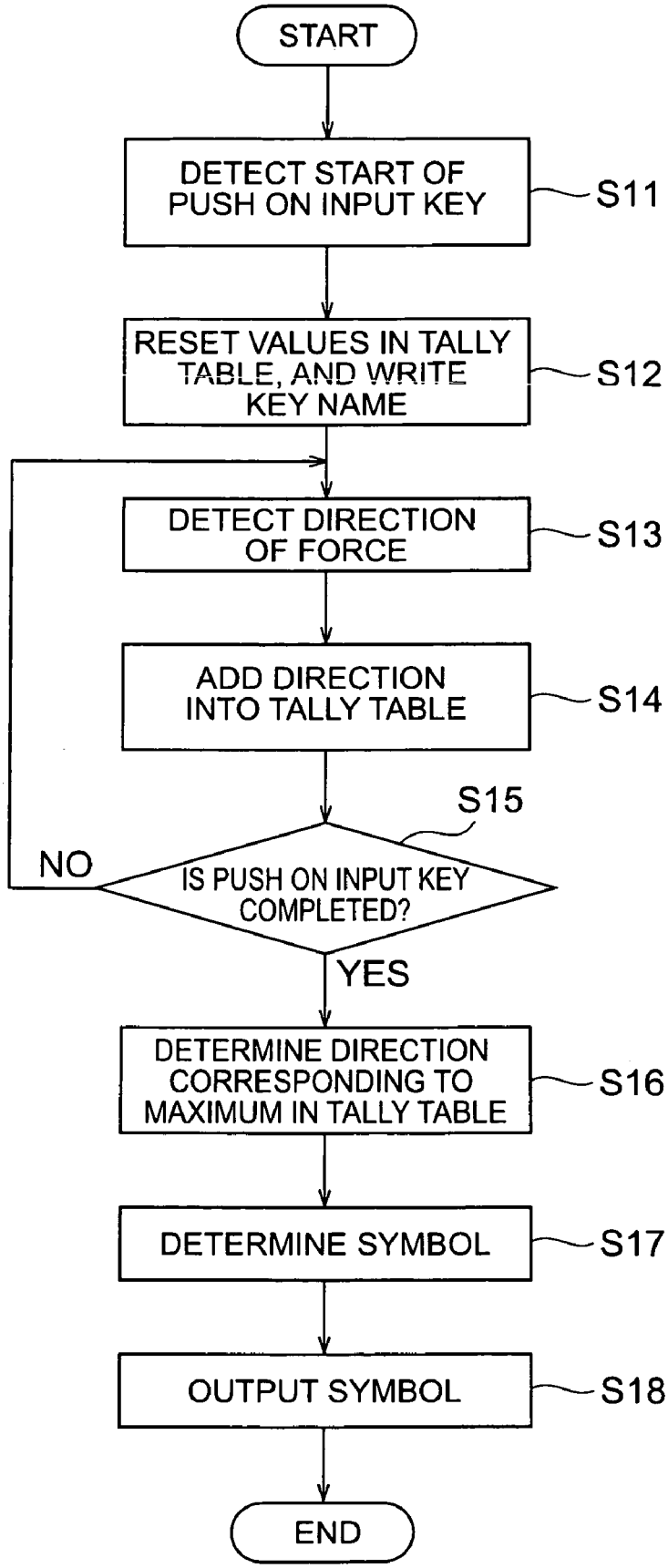
FIG. 9 is a flowchart showing processing in the first embodiment.

The processing executed in the input apparatus 200 of the present embodiment is much the same as that described in the above first embodiment except for the detection of the direction of the force exerted on the input key 10 (S13 in FIG. 9). The process of detection of the direction will be described below.

First, the direction detector 38 determines a direction of force in each strain gage 70 in a manner similar to the aforementioned direction on the direction, using the first decision table shown in FIG. 20. Here, A to D in the above decision table represent resistances of the respective strain gage pieces 70*a*-70*d*, and $\alpha$ a predetermined positive value indicating the above "difference". Furthermore, $\beta$ is a predetermined positive value used to determine whether there is no force applied perpendicularly to a direction in question; for example, for making a decision on a force in the left direction, it is used to determine whether there is no force applied in the directions vertical to the left direction, i.e., in the up and down directions.

A direction is made on the direction of the force exerted on the input key 10 with reference to the second decision table shown in FIG. 21, based on directions of force in the respective strain gages 70 obtained as described above. Specifically, for example, where a force is exerted in the right direction on the input key 10 to push the input key 10, the direction is determined to be right in all the above strain gages 70, and it is determined that the direction of the force exerted on the input key 10 is the right direction, based on the directions thus determined and based on the second decision table.

As described above, the input apparatus 200 of the present embodiment obviates the need for attaching the strain gages to the input key 10 itself, and thus can prevent increase of weight of the input key 10 and prevent the key touch from becoming weighty. The input key 10 itself can be one of the conventional keys.

Figure 22:
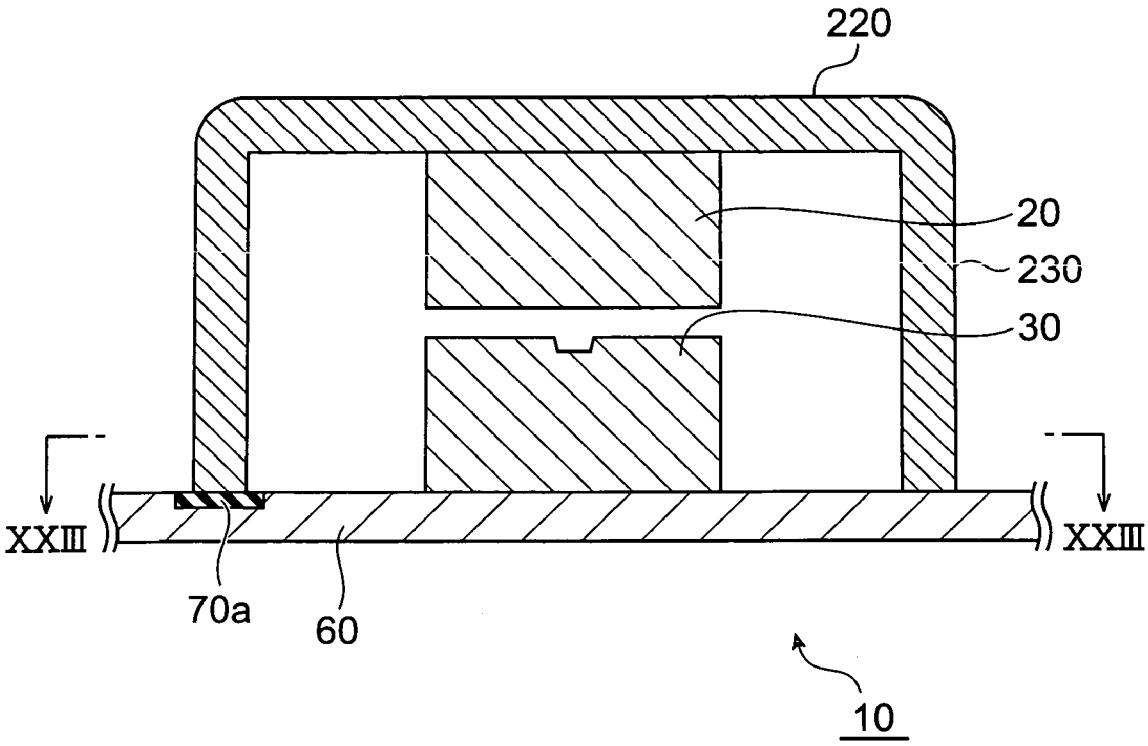
FIG. 22 is a vertical sectional view of an input key in another example in the second embodiment.
Figure 23:
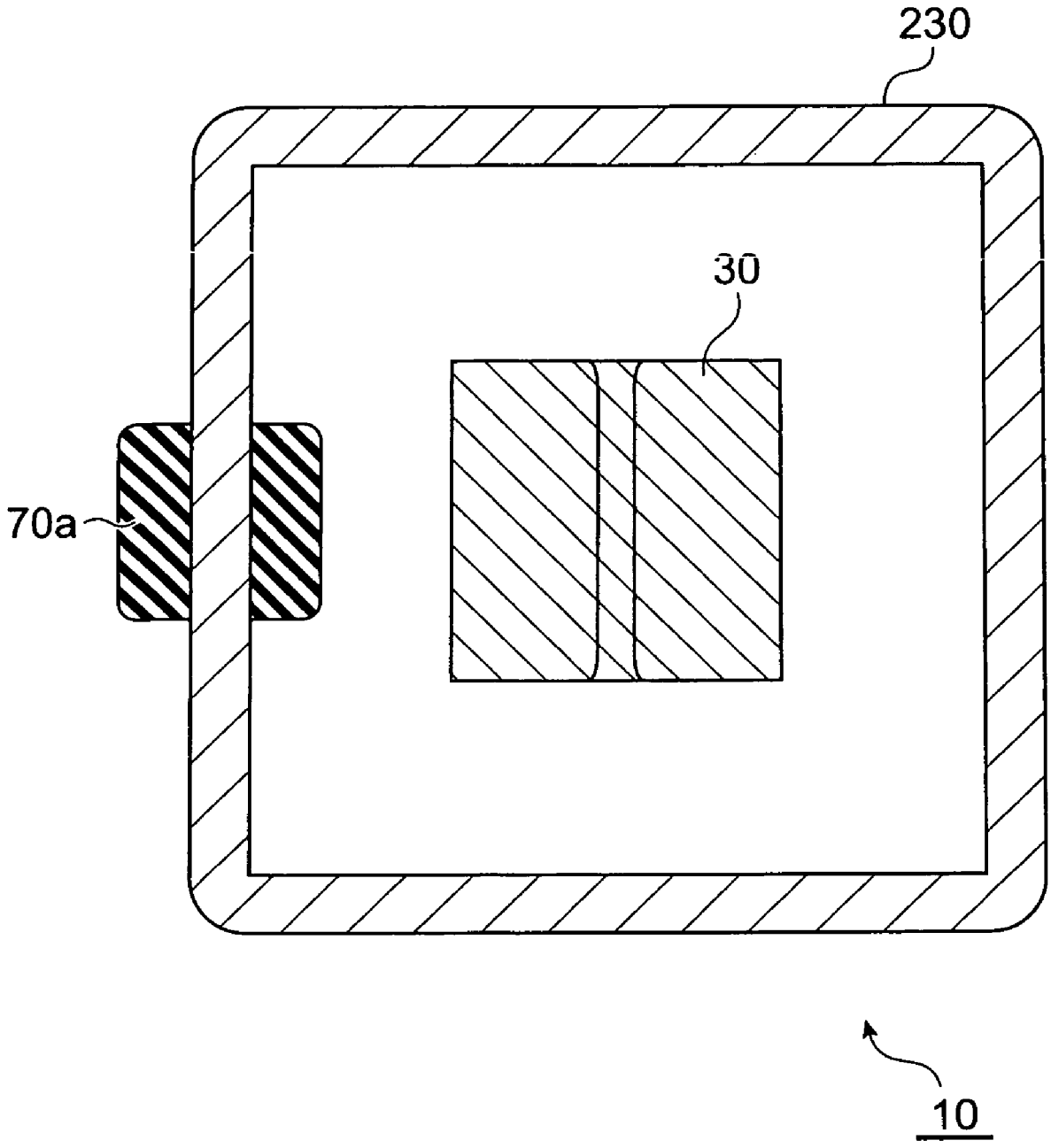
FIG. 23 is an XXIII-XXIII sectional view of an input key shown in FIG. 22 in the second embodiment.

In the present embodiment, since each strain gage 70 is able to detect the up, down, left, and right directions of force, it is also possible to use only one strain gage 70*a*, as shown in FIGS. 22 and 23. The above implements a simpler configuration of input key 10 and thus achieves reduction of cost.

Figure 27:
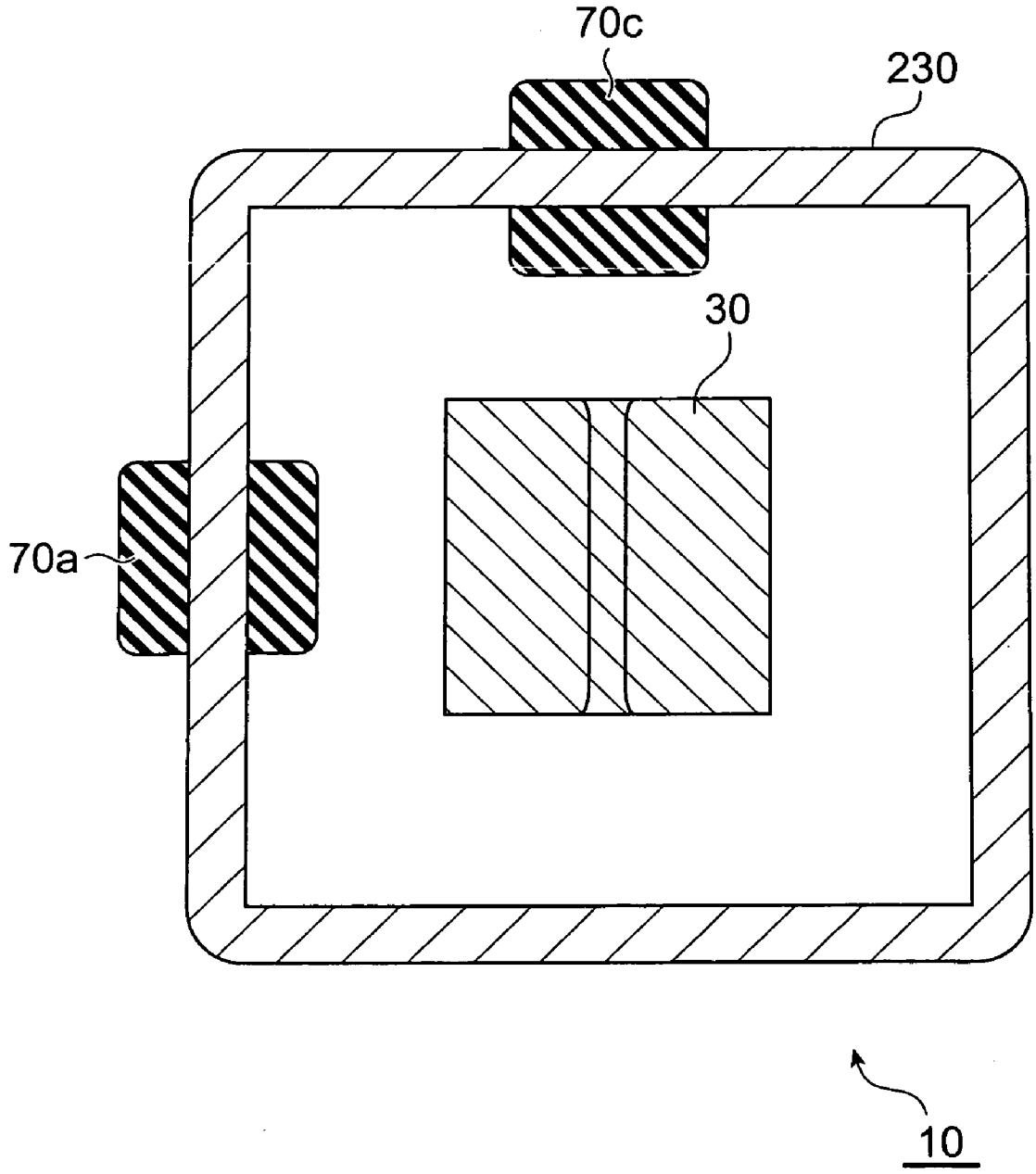
FIG. 27 is a sectional view of an input key in another example in the second embodiment.

In the present embodiment each strain gage 70 consists of four strain gage pieces 71 and is arranged to be able to detect the up, down, left, and right directions of force. However, the apparatus may be configured so that, as shown in FIG. 24(*a*), each strain gage 70 includes two strain gage pieces 71 so as to be able to detect only the left and right directions of force, using the first decision table shown in FIG. 25(*a*), and that a direction is made on a direction of a force exerted on the input key 10, based on directions of force in the respective gages 70 and based on the second decision table shown in FIG. 26. The apparatus may also be configured so that, as shown in FIG. 24(*b*), each strain gage 70 includes two strain gage pieces 71 so as to be able to detect only the up and down directions of force, using the first decision table shown in FIG. 25(*b*), and that a decision is made on a direction of a force exerted on the input key 10, based on the directions of force in the respective gages 70 and based on the second decision table shown in FIG. 26. In the above case, the number of strain gages 70 may be two as shown in FIG. 27 and the second decision table shown in FIG. 28 may be used for the decision on the direction. The above implements a simpler configuration of the input key 10 and achieves further reduction of cost.

Third Embodiment

Figure 29:
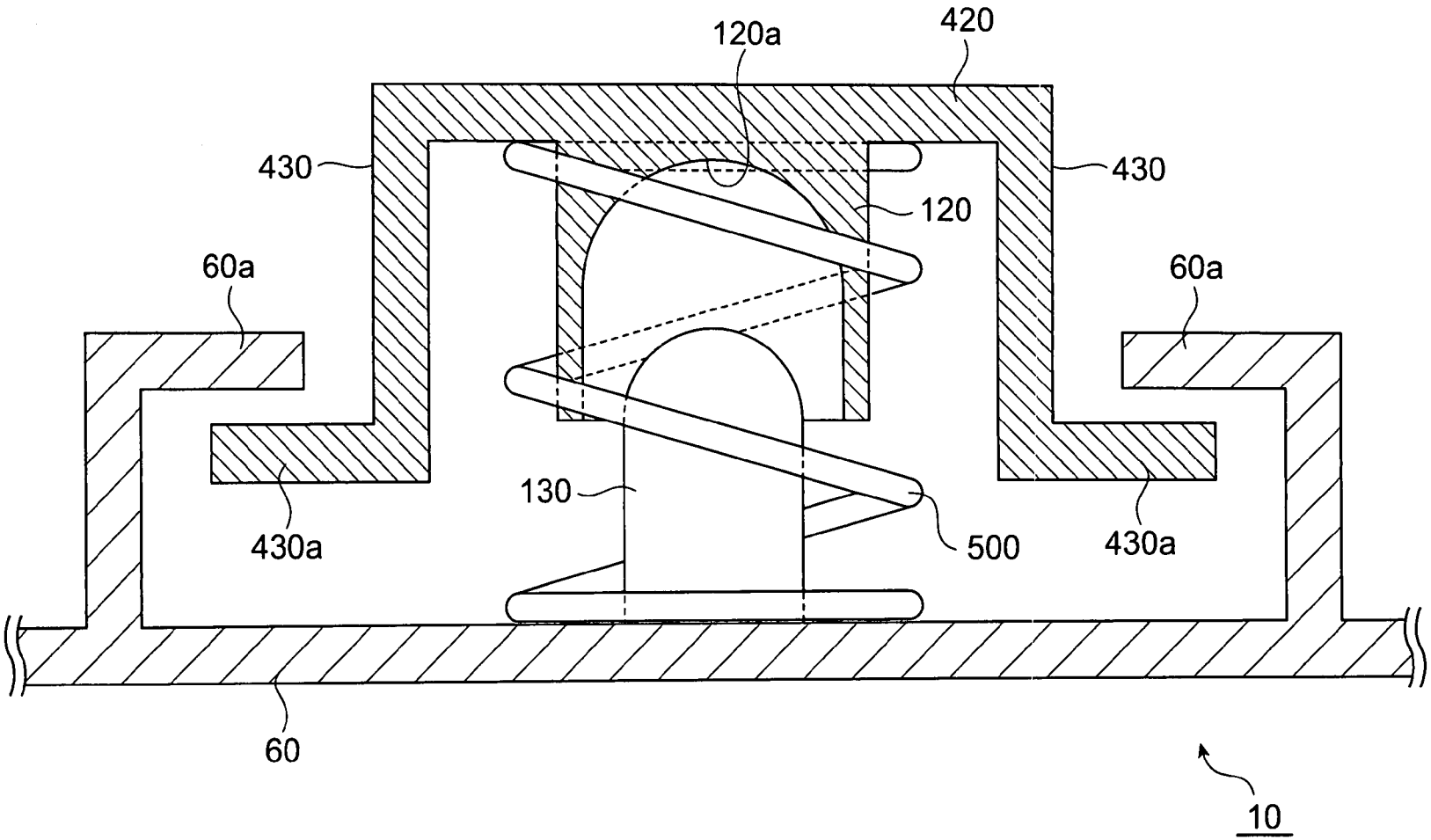
FIG. 29 is a vertical sectional view of an input key in the third embodiment.

FIG. 29 shows a cross section of an input key 10 in the third embodiment. The exterior configuration and functional configuration of input apparatus 200 are similar to those in the first embodiment. As shown in FIG. 29, the input key 10 is comprised of an upper electrode 120, a lower electrode 130, a key top 420, a key skirt 430, and a spring 500. The key top 420 and key skirt 430 are integral with each other and are made of a material with some hardness, e.g., hard plastic, metal, or the like. A key skirt edge 430*a* engages with a support plate flange 60*a* of support plate 60, whereby the key top 420 is prevented from slipping off from the support plate 60. The upper electrode 120 is made of a material similar to that of the key top 420 and in cylindrical shape, and is located so as to be stuck to the key top 420 inside the input key 10. The lower part of the upper electrode 120 is of a round concave shape and is loosely engageable with the lower electrode 130 having the upper part of a round convex shape.

Figure 30:
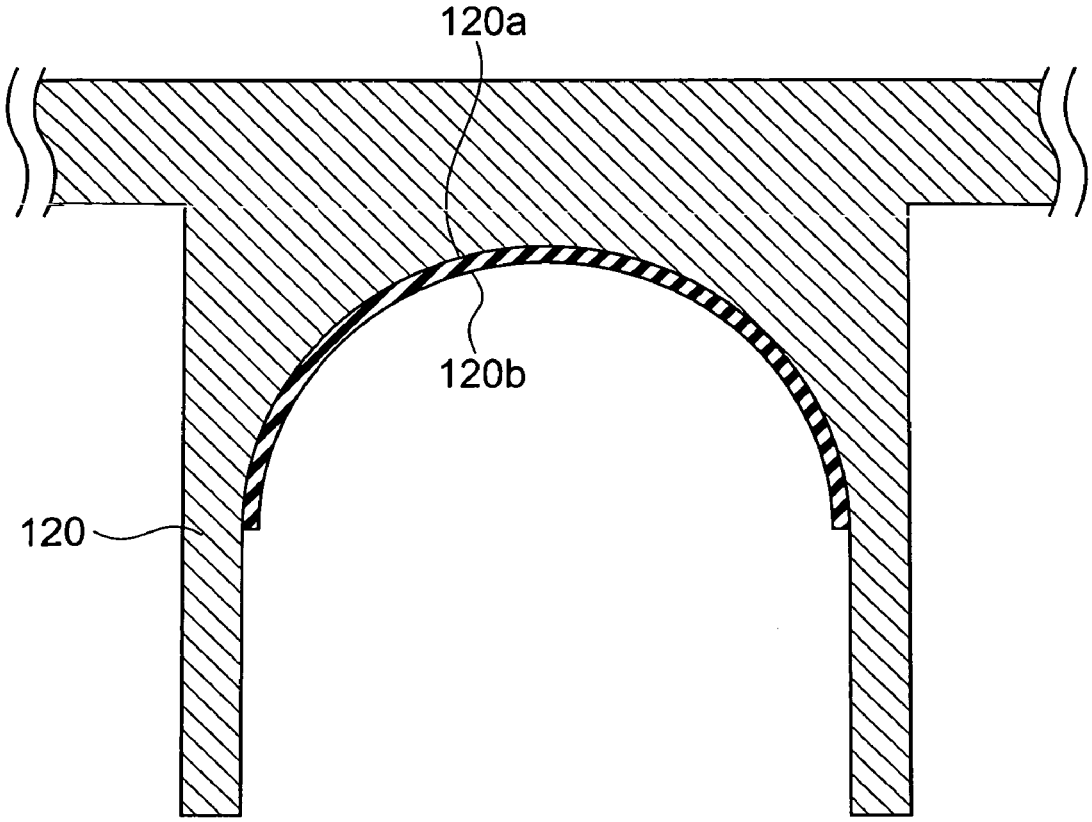
FIG. 30 is an enlarged view of an interior portion of a key top in the third embodiment.
Figure 31:
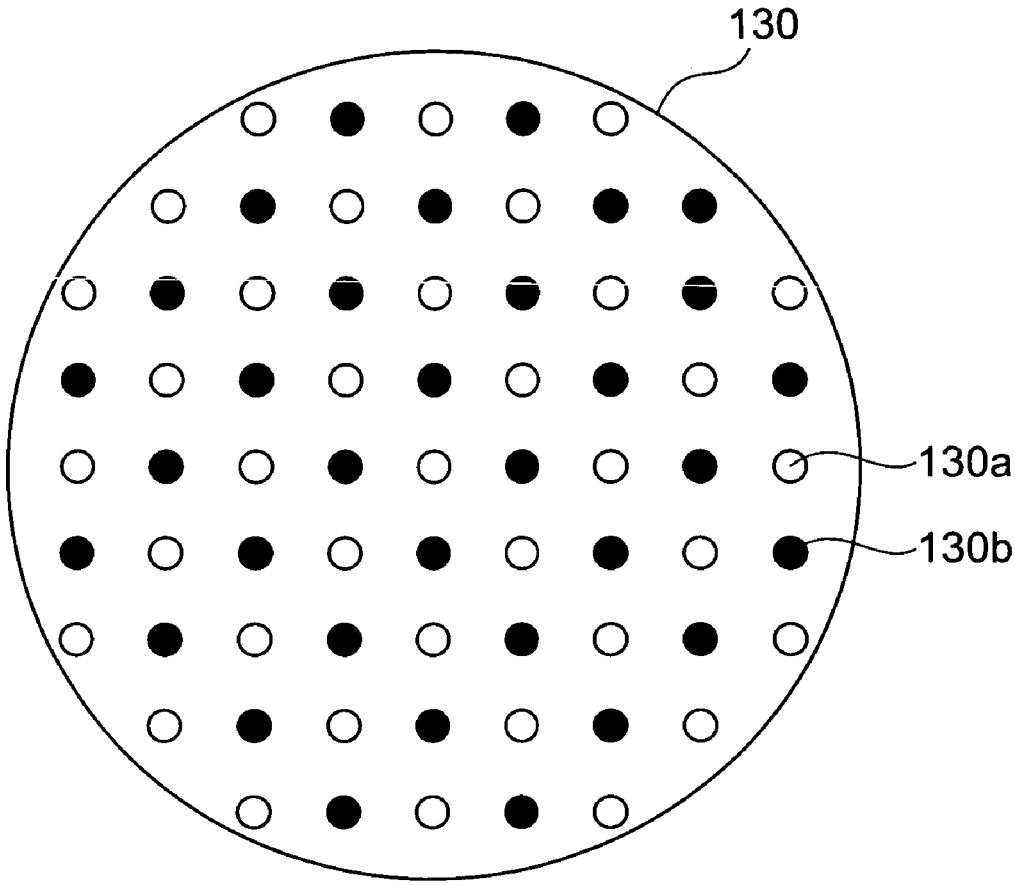
FIG. 31 is a top plan view of a lower electrode located inside an input key in the third embodiment.

As shown in FIG. 30, a concave surface portion 120*a* of the upper electrode 120 is provided with an electric contact 120*b* of a metal piece over the entire surface. The lower electrode 130 is provided on the support plate 60 inside the input key 10 and is located with a clearance below the upper electrode 120. The lower electrode 130 is cylindrical and the upper part thereof is of the round convex shape. As shown in FIG. 31, thousands of electric contacts 130*a*, 130*b* are provided on the upper part of the convex shape of the lower electrode 130. The electric contacts consist of those of white dots 130*a* and those of black dots 130*b*, and these electric contacts 130*a*, 130*b* go into an electrically conducting state when the upper electrode 120 is brought into contact with the lower electrode 130 to establish contact of the electric contact 120*b* of the upper electrode with the electric contacts 130*a*, 130*b*. As also described in the first embodiment, the push detector 36 detects the conducting state to detect a push on the input key 10.

Figure 32:
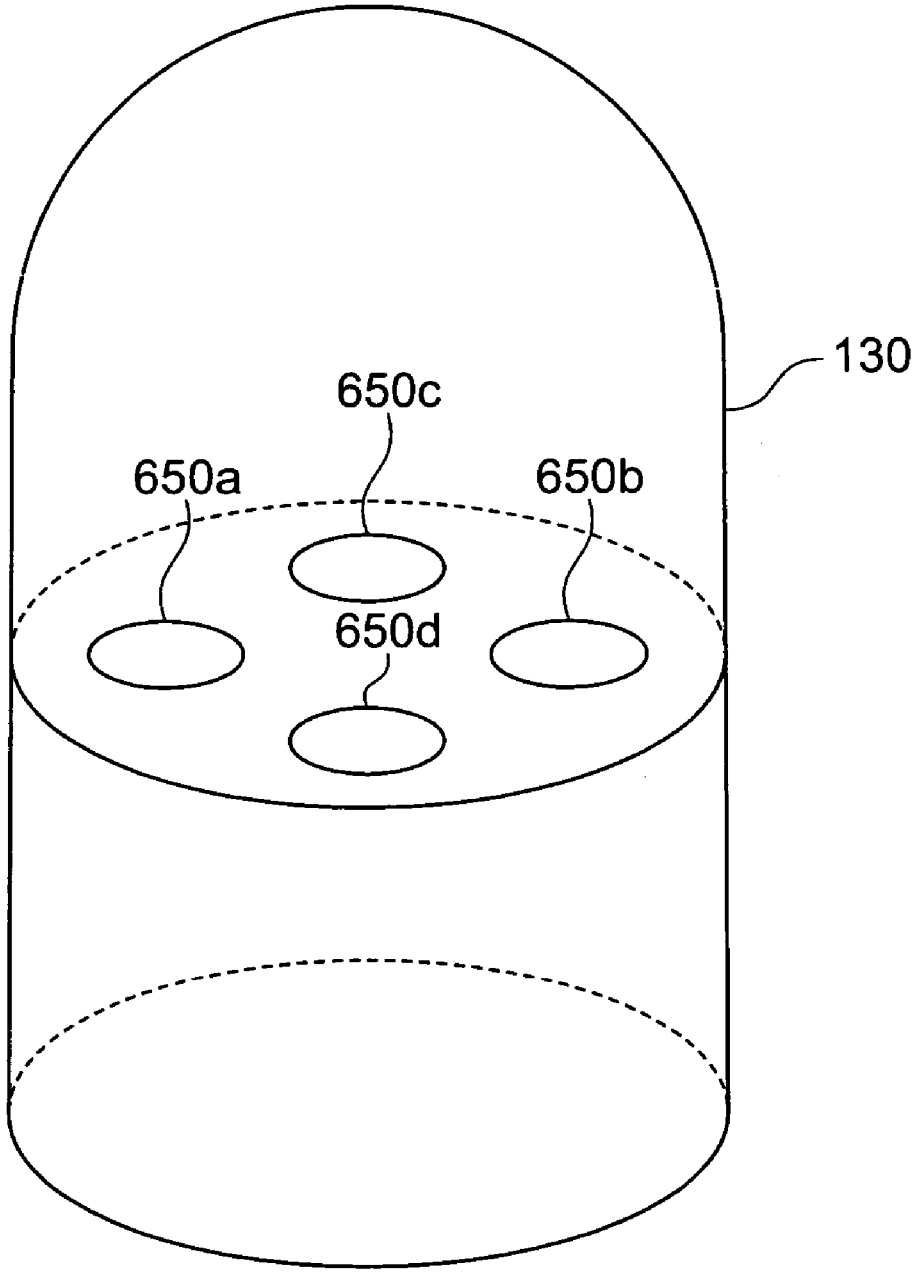
FIG. 32 is an illustration showing a lower electrode located inside an input key in the third embodiment.

Furthermore, the lower electrode 130 is made of an elastically deformable, flexible material, and is provided with strain gages 650 (generically used to refer to strain gages 650*a*-650*d*) inside thereof, as shown in FIG. 32. The spring 500 is provided so as to surround the upper electrode 120 and lower electrode 130 of cylindrical shape, one end of the spring vertically pushes up the key top 420, and the other end vertically pushes down the support plate 60. In a normal state (a state without force on the input key 10), the key top 420 is at a stop at a position where the key skirt edge 430*a* is in contact with the support plate flange 60*a*.

The processing executed in the input apparatus 200 of the present embodiment is much the same as that described in the first embodiment except for the detection of a push on the input key 10 and the detection of the direction of force (S11 and S13 in FIG. 9). The processes of the detection of the push and the detection of the direction will be described below.

As the user pushes the input key 10 with a force in a direction corresponding to a symbol to be inputted, the spring 500 is compressed to bring the upper electrode 120 into contact with the lower electrode 130 to establish the conducting state, and the push detector 36 detects the push on the input key 10 (corresponding to S11 in FIG. 9).

Figure 33:
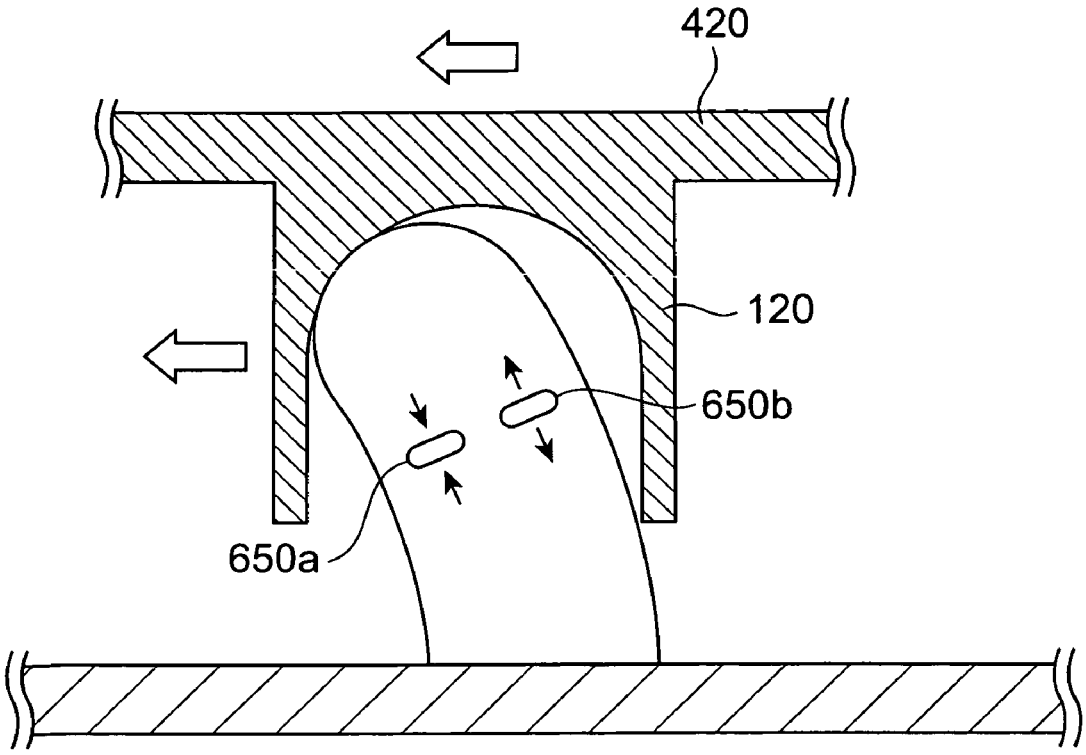
FIG. 33 is an illustration showing a state in which a lower electrode located inside an input key is deformed in the third embodiment.

On the other hand, as shown in FIG. 33, the force applied in the direction corresponding to the symbol to be inputted is transmitted through the concave shape portion of the upper electrode 120 to the lower electrode 130, whereby there arises strain in the direction corresponding to the symbol to be inputted, in the lower electrode 130. The strain arising in the lower electrode 130 deforms the strain gages 650 provided inside the lower electrode 130, and, based on change of resistances of the strain gages 650 due to the strain, the direction detector 38 detects the direction of the force exerted on the input key 10 in a manner similar to that in the above embodiment (corresponding to S13 in FIG. 9).

As described above, the input apparatus 200 of the present embodiment uses the spring in the input key 10, which can improve the click feel when the user pushes the input key 10.

Figure 34:
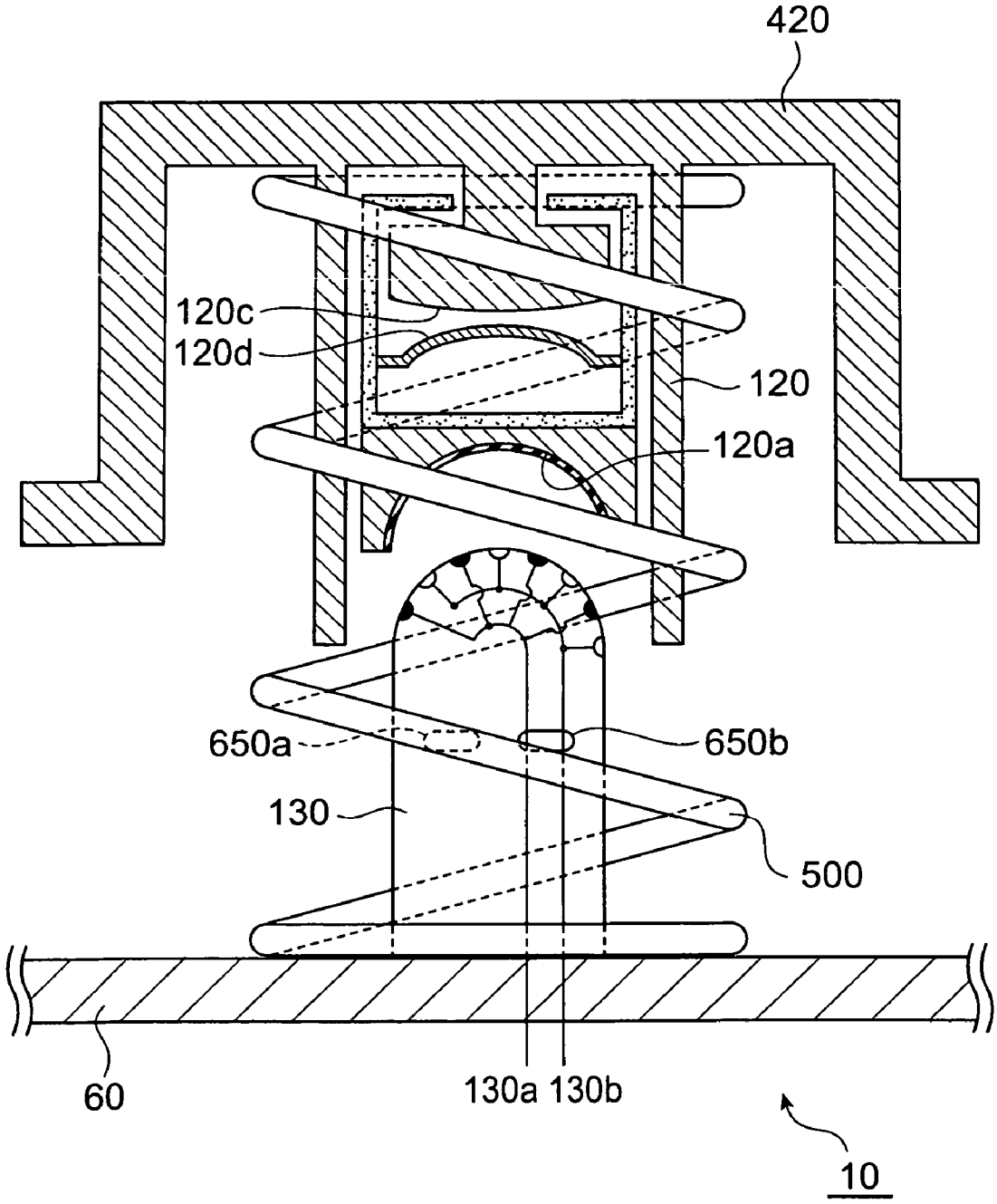
FIG. 34 is a sectional view of an input key in another example in the third embodiment.

In the present embodiment, it is also possible to adopt a configuration further comprising a piston 120*c* and an embossed sheet 120*d* inside the upper electrode 120, as shown in FIG. 34.

In the above input apparatus 200, as the user pushes the input key 10, the piston 120*c* and the embossed sheet 120*d* similarly descend until the upper electrode 120 and the lower electrode 130 go into contact. As the user further applies a force after the contact is established between the upper electrode 120 and the lower electrode 130, the piston 120*c* and the embossed sheet 120*d* go into contact with each other. Before the force reaches a given level, the embossed sheet 120*d* gives a reaction force. When the force applied exceeds the given level, the embossed sheet surfaces, in order to secure the contact surfaces as wide as possible.

Figure 44:
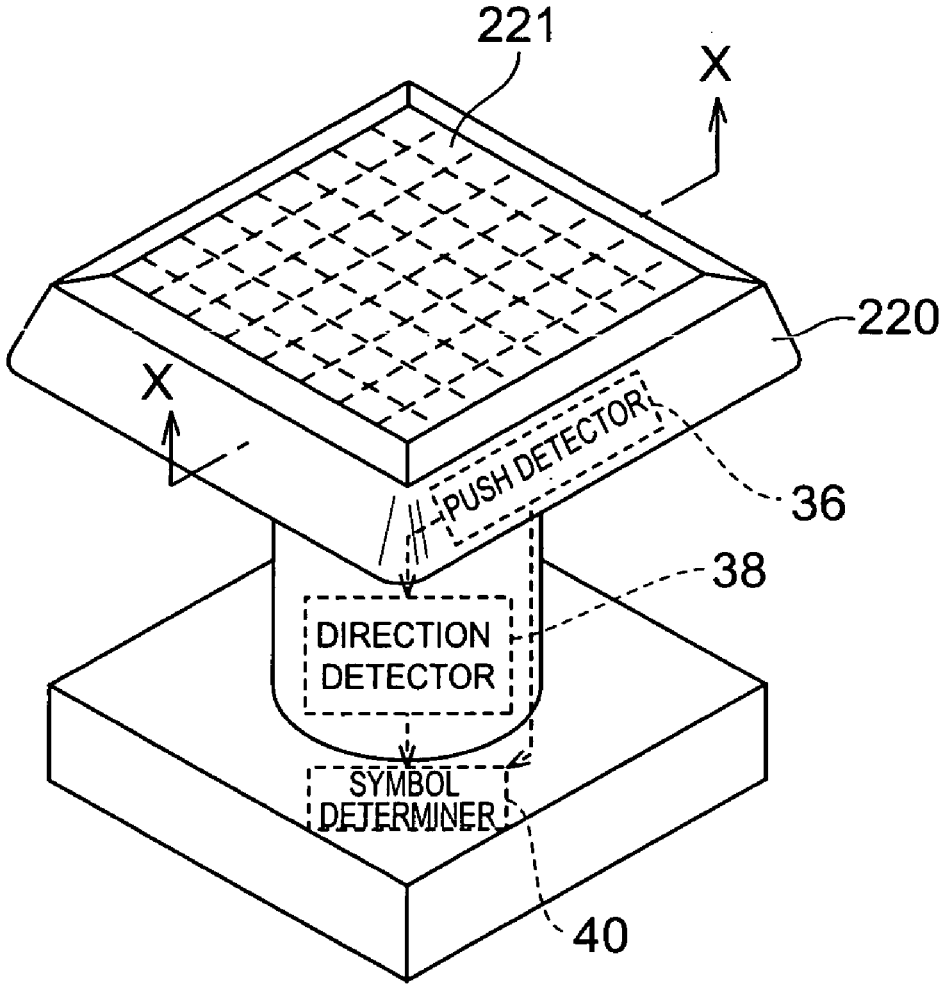
FIG. 44 is an illustration showing a configuration example for push detection and direction detection in which a large number of strain gages are arranged in the vicinity of a surface of a key top.
Figure 45:
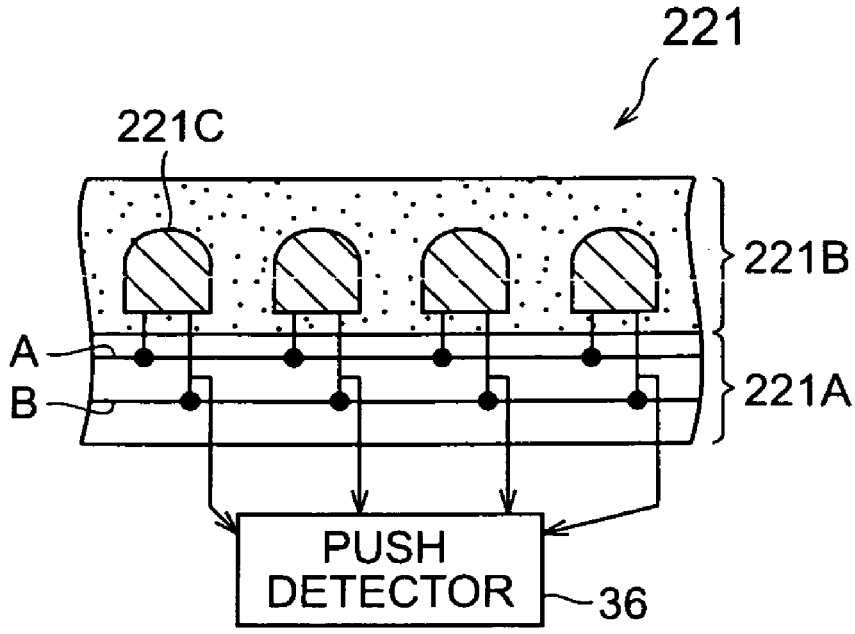
FIG. 45 is a drawing showing a cross section along X-X line in FIG. 44 in an unpushed state and a cross section along X-X line in FIG. 44 in a pushed state.

A configuration example in which the push detection and the direction detection are carried out with a large number of strain gages placed in the vicinity of the surface of the key top 220 will be described below with reference to FIGS. 44 and 45. FIG. 45 shows a sectional view along X-X line in FIG. 44 (input key configuration example). In a sensor part 221 of the key top 220 shown in FIG. 44, a layer of an elastically deformable, flexible material (e.g., synthetic rubber, soft plastic, soft vinyl, or the like) 221B is formed on a substrate 221A, as shown in FIG. 45, and strain gages 221C are embedded in two-dimensional arrangement along the direction along X-X line in FIG. 44 and along the direction perpendicular thereto and over the entire surface of the sensor part 221, in the layer of flexible material 221B.

The strain gages 221C have a property that at occurrence of strain under pressure their electrical resistance demonstrates a predetermined change according to an amount of the strain. Output terminals of each strain gage 221C are electrically connected to two electric wiring lines A, B, and a given potential difference is established between these electric wiring lines A, B by an unrepresented dc power supply or the 120*d* gets dented at a breath, so as to instantaneously decrease the reaction. In the manner as described above, where the user pushes the input key 10 by a finger, the user can sense the decrease of reaction at the fingertip. As the user lifts the finger from the input key 10, the embossed sheet 120*d* gradually returns from the dented state of the center bulging portion to the original shape, so as to elevate the input key 10. When the center bulging portion returns up to a certain shape, it suddenly generates a strong restoring force to quickly strengthen the force to lift the input key 10.

The above permits the user of the input apparatus 200 to further obtain a touch of a push on the key top 420, so called a "click feel", when pushing the input key 10 provided in the input apparatus 200. In addition, it provides the user with a light keying feel.

In the above embodiment the upper electrode 120 and lower electrode 130 are of cylindrical shape, but they may also be of rectangular column shape, as shown in FIG. 35(*a*) and (*b*). This configuration is particularly preferable, for example, in cases where the direction of force to be applied is limited to the four directions of up, down, left, and right. Even in this case, contact surfaces are preferably curved like. For this reason, when a strain occurs in a certain strain gage 221C under pressure, the electrical resistance of the strain gage 221C demonstrates a predetermined change according to an amount of the strain, and the value of an electric current flowing in the strain gage 221C varies according to the strain amount.

The value of the electric current flowing in each strain gage 221C is detected by an unrepresented electric current detector and the electric current value information is fed to the push detector 36. Receiving the electric current value information, the push detector 36 first detects which strain gage 221C is subject to pressure over a reference value, based on the current value information of each strain gage 221C, to detect a push on the key top 220. When the push detector 36 detects the push, it continuously outputs the information of the values of electric currents flowing in the respective strain gages 221C, to the direction detector 38 for a predetermined period, and the direction detector 38 measures a distribution of pressures at respective points from the strain gages 221C, calculates a center of gravity of the pressure distribution (center), and detects the direction of the push on the key top 220, based on the position of the center of gravity or based on a direction of a change of the center of gravity over the predetermined period. Then the information about the direction of the push on the key top 220 detected by the direction detector 38 is fed to the symbol determiner 40, and the symbol determiner 40 can determine the symbol information corresponding to the direction of the push.

Fourth Embodiment

The fourth embodiment will be described below as an embodiment adopting a mechanism of detecting strain caused by force in the up, down, left, and right directions on the key top, in the upper part of the key top or in the peripheral part of the surface of the key top.

Figure 47:
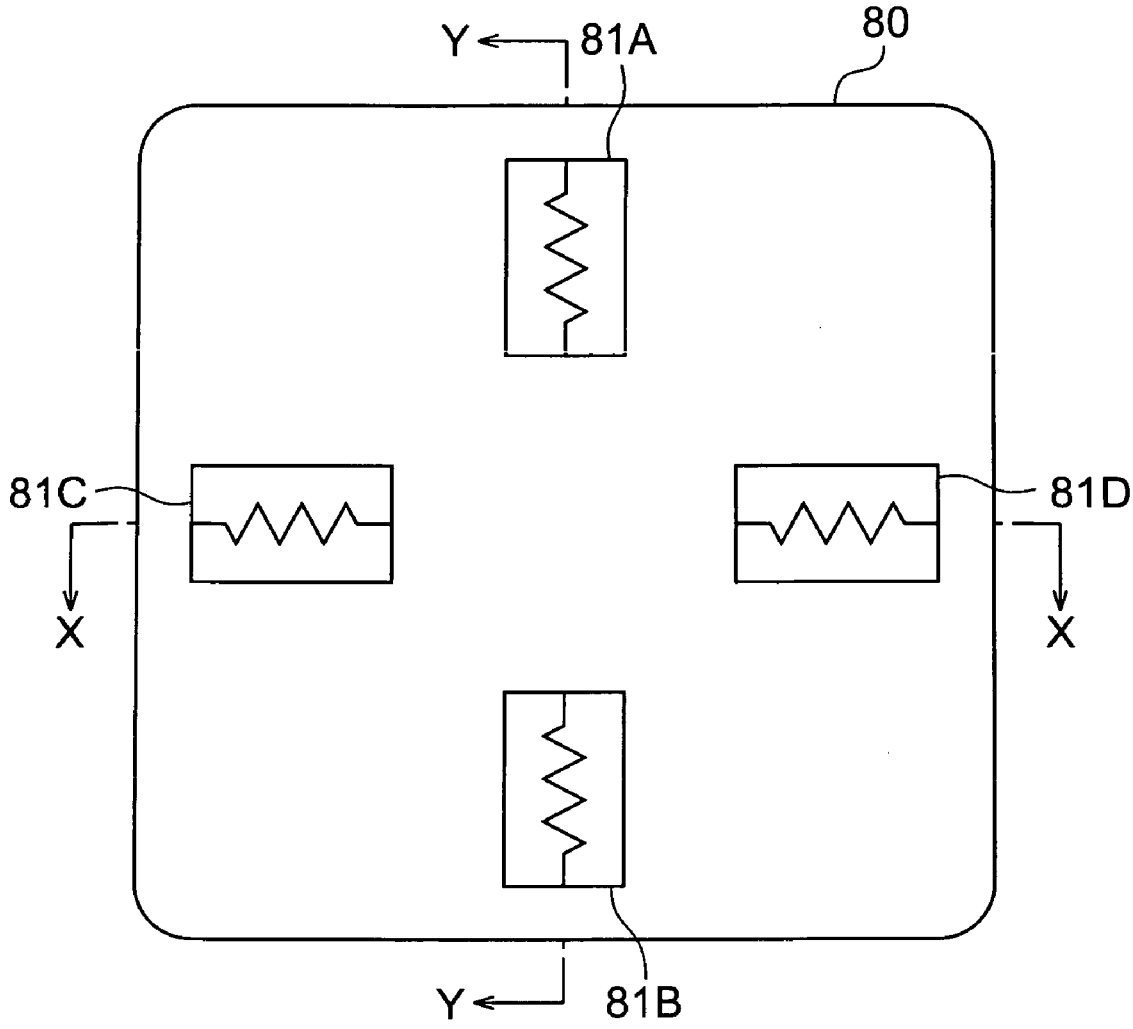
FIG. 47 is a plan view of a key top in the fourth embodiment.

FIG. 47 is a plan view of a key top 80 in the fourth embodiment, and the key top 80 is made of an elastically deformable material. Strain gages 81A-81D for detecting strain caused by force in the up, down, left, and right directions in FIG. 47 are embedded in this key top 80 (each strain gage is indicated by solid lines in FIG. 47, for convenience' sake). Among these strain gages, those 81A, 81B detect strain caused by force in the up and down directions in FIG. 47, and those 81C, 81D detect strain caused by force in the left and right directions in FIG. 47.

FIG. 48(*a*) shows a cross-sectional view along X-X line in FIG. 47. As shown in this FIG. 48(*a*), the strain gages 81C, 81D are embedded with opposite inclinations (e.g., 45° with respect to the surface of the key top 80) in the key top 80, in order to distinctively detect the strain due to force in the left direction and the strain due to force in the right direction in FIG. 47 and FIG. 48(*a*). In this configuration, where the key top 80 is deformed in the left direction in FIGS. 47 and 48(*a*), the strain gage 81C is subject to pressure in the compressing direction of the strain gage 81C, while the strain gage 81D is subject to pressure in the stretching direction of the strain gage 81D. This direction decision method will be described later.

As shown in FIG. 48(*a*), the key top 80 is set on a key top base 82, and the key top base 82 is arranged in an aperture provided in a top surface of substrate 83. Key top skirts 82A, 82B projecting outward inside the aperture in the top surface of the substrate 83 are formed at the bottom edge of the key top base 82, so as to prevent the key top base 82 and the key top 80 from slipping off from the substrate 83. Key top supports 90 made of an elastically deformable material (e.g., synthetic rubber, a spring, or the like) connect between the key top skirt 82A and an opposed surface 83A of the substrate 83 and between the key top skirt 82B and an opposed surface 83B of the substrate 83. The key top base 82 including the key top skirts 82A, 82B is made of a material with some hardness, and this prevents the key top base 82 and the key top 80 from slipping off from the substrate 83 and facilitates deformation of only the key top 80 of the elastic material in which the four strain gages are embedded.

In a bottom surface of the key top base 82, an upper electrode 84 is set in the central region of the bottom surface, strain-gage upper electrodes 88A, 88B are set in the vicinity of the embedded part of the strain gage 81C, and strain-gage upper electrodes 86A, 86B are set in the vicinity of the embedded part of the strain gage 81D. Ends of the strain gage 81C are electrically connected to the respective strain-gage upper electrodes 88A, 88B, and ends of the strain gage 81D are electrically connected to the respective strain-gage upper electrodes 86A, 86B.

On the other hand, a lower electrode 85, and strain-gage lower electrodes 89A, 89B, 87A, and 87B are set at the positions corresponding to the upper electrode 84 and the strain-gage upper electrodes 88A, 88B, 86A, and 86B, respectively, on an opposed surface of the substrate 83 to the key top base 82. The resistance of each strain gage 81A-81D decreases when the strain gage is compressed, and increases when the strain gage is stretched. A cross section along Y-Y line in FIG. 47 shows much the same configuration as the X-X cross section of FIG. 48(*a*) described above, and the description thereof is omitted herein.

The functional configuration of the input apparatus in the fourth embodiment is similar to the configuration of the input apparatus 200 in FIG. 2 described above, and the illustration thereof is omitted herein. However, electric signals from the respective strain-gage lower electrodes 89A, 89B, 87A, and 87B are fed to the direction detector 38, and the direction detector 38 detects the strain caused by force in the up, down, left, and right directions exerted on the key top 80, to make a decision on the direction of the force exerted on the input key.

The processing for detecting the strain caused by force in the up, down, left, and right directions on the key top 80 will be described below as the operation of the present embodiment. An example will be described herein using a case where strain due to a force in the direction indicated by an arrow L (in the left direction in FIG. 47) occurs in the key top 80, as shown in FIG. 48(*b*).

When the key top 80 is pushed, as shown in FIG. 48(*b*), the upper electrode 84 becomes electrically connected to the lower electrode 85 and, similarly, the strain-gage upper electrodes 88A, 88B, 86A, and 86B become electrically connected to the opposed strain-gage lower electrodes 89A, 89B, 87A, and 87B, respectively. This results in feeding an electric signal from the strain gage 81C through the strain-gage lower electrodes 89A, 89B to the direction detector 38, and the direction detector 38 determines the resistance of the strain gage 81C from the current value of the electric signal. Similarly, the direction detector 38 determines the resistances of the strain gages 81A, 81B, and 81D.

For example, where strain due to force in the direction indicated by arrow L (in the left direction in FIG. 47) occurs in the key top 80, as shown in FIG. 48(*b*), the strain gage 81D is stretched while the strain gage 81C is compressed. The strain gages 81A, 81B undergo little compression or expansion. This results in increasing the resistance of the strain gage 81D (hereinafter referred to as "resistance D"), decreasing the resistance of the strain gage 81C (hereinafter referred to as "resistance C"), and hardly changing the resistance of the strain gage 81A (hereinafter referred to as "resistance A") and the resistance of the strain gage 81B (hereinafter referred to as "resistance B"). Namely, the resistance D becomes a predetermined value or more larger than the resistance C, and the difference between the resistances A, B is close to 0.

Therefore, the conditions that the resistance D is not less than (resistance C+predetermined positive value $\alpha$) and that the difference between the resistances A, B is not more than the predetermined positive value $\beta$ are met, as shown in FIG. 49, whereby the direction detector 38 determines that the strain due to the force in the left direction in FIG. 47 occurs in the key top 80, and thus makes a decision based thereon that the direction of the force exerted on the input key is the left direction in FIG. 47.

Similarly, where the strain due to the force in the reverse direction (in the right direction in FIG. 47) to the arrow L in FIG. 48(*b*) occurs in the key top 80, the strain gage 81C is stretched while the strain gage 81D is compressed. The strain gages 81A, 81B undergo little compression or expansion. This results in increasing the resistance C, decreasing the resistance D, and hardly changing the resistances A, B. Namely, the resistance C becomes a predetermined value or more larger than the resistance D, and the difference between the resistances A, B is close to 0. Therefore, the conditions that the resistance C is not less than (resistance D+predetermined positive value $\alpha$) and that the difference between the resistances A, B is not more than the predetermined positive value $\beta$ are met, as shown in FIG. 49, whereby the direction detector 38 determines that the strain due to the force in the right direction in FIG. 47 occurs in the key top 80 and thus makes a decision based thereon that the direction of the force exerted on the input key is the right direction in FIG. 47.

The detection is also carried out in similar fashion in cases where the strain due to force in the up direction or in the down direction in FIG. 47 occurs in the key top 80.

In this manner, it is feasible to readily substantialize the mechanism of detecting the direction of the force by detecting the direction of the strain caused by the force in the up, down, left, or right direction on the key top, and to implement the input key and the input apparatus superior in cost and in readiness of implementation.

Particularly, the present embodiment provides the significant advantage in capability of distinctively detecting the strains due to the force in each of the up, down, left, and right directions in FIGS. 47 and 48(*a*) thanks to the configuration wherein the strain gages 81C, 81D are embedded with mutually opposite inclinations in the key top 80 and wherein the strain gages 81A, 81B are embedded with mutually opposite inclinations in the key top 80.

Figure 46:
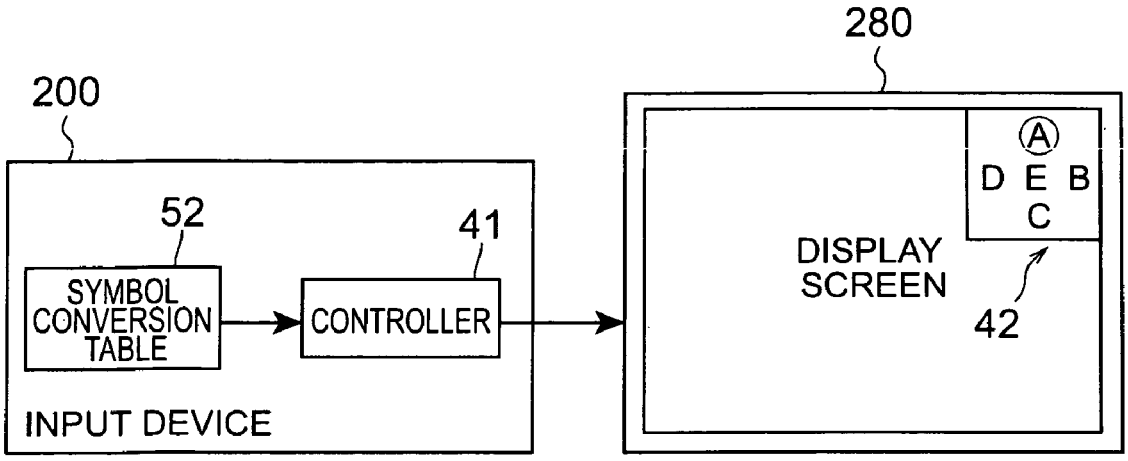
FIG. 46 is an illustration showing a configuration example provided with a feedback function to feed up-to-date information of conversion table back to a user.

Incidentally, each of the above embodiments is preferably configured to be able to feed the up-to-date information of the conversion tables about the input keys back to the user during the push operation on the input key by the user. A configuration with such feedback function of the up-to-date information of conversion tables to the user will be described below. As shown in FIG. 46, the input apparatus 200 is further provided with a controller 41, and during a push operation on an input key (i.e., during a period from a start of the operation on the key top to confirmation of operation settlement by a switch) the controller 41 outputs to the display screen 280 information of the conversion table 52 about the input key at that time (information assigned to each direction) to highlight the input candidate information corresponding to the push operation at the present time on the display screen 280. For example, like an image 42 shown at the upper right corner of the display screen 280, it is feasible to feed back to the user such information that symbols A to E are assigned to the respective directions and that symbol "A" highlighted by a circle is presently selected.

The feedback is desirably carried out, for example, at a time of a change in assignment of plural input information elements to the input keys according to frequencies of use or the like, or at timing immediately after manipulation of the F key 162 in FIG. 37 (i.e., immediately after a mode changeover of symbol input) even without any change in assignment, and this achieves the three effects below. Namely, (1) in the case of a change in assignment of symbol information or the like to the input keys according to frequencies of use or the like, the user can check the up-to-date assignment information in the image 42 at the upper right corner of the display screen 280 during a push operation on the input key. (2) For example, in the case where the input mode is switched from the input mode of the Japanese hiragana writing symbols to the alphabet input mode, the user can check the up-to-date assignment information of the different input mode, which is not easily indicated by only the display on the key top, in the image 42. Furthermore, (3) the user can also check in the image 42 the information as an input candidate corresponding to a push operation at that moment (information selected at the present time). This feedback function of the up-to-date assignment information can dramatically improve easiness and certainty of the user operation.

The disclosure of Japanese Patent Application No. 2003-406230 filed Dec. 4, 2003 including specification, drawings and claims, and the disclosure of Japanese Patent Application No. 2004-292915 filed Oct. 5, 2004 including specification, drawings and claims are incorporated herein by reference in its entirety.

What is claimed is:

1. An input key which is assigned a plurality of information items to be inputted according to a direction of a force exerted on the input key, the input key comprising:

push detecting means for detecting a push on the input key;

direction detecting means for detecting a strain occurring in the input key and thereby detecting a direction of a force exerted on the input key when the push detecting means detects a push on the input key;

a first projecting portion to be pushed together with a key top; and a second projecting portion set on a support plate for supporting the input key, wherein one of the first and second projecting portions is of a convex shape, the other projecting portion is of a concave shape, and the two projecting portions are loosely engageable with each other when the input key is pushed, the projecting portion of the convex shape is formed of an elastically deformable member and a strain gage is attached to the projecting portion of the convex shape, and when the push detecting means detects a push on the input key, the direction detecting means detects a strain by means of the strain gage attached to the projecting portion of the convex shape, to detect a direction of a force exerted on the input key.

2. The input key according to claim 1, the input key comprising portions which go into contact with each other inside the input key when the input key is pushed, wherein either one or both of the portions to go into contact are formed of an embossed sheet.

3. An input apparatus comprising at least one input key which is assigned a plurality of information items to be inputted according to a direction of a force exerted on the input key, the input apparatus comprising:

push detecting means for detecting a push on the input key;

direction detecting means for detecting a strain occurring in the input key and thereby detecting a direction of a force exerted on the input key when the push detecting means detects a push on the input key; and information determining means for determining an input information item based on the direction detected by the direction detecting means, and wherein the input key internally comprises a first projecting portion to be pushed together with a key top, and a second projecting portion set on a support plate for supporting the input key, wherein one of the first and second projecting portions is of a convex shape, the other projecting portion is of a concave shape, and the two projecting portions are loosely engageable with each other when the input key is pushed, the projecting portion of the convex shape is formed of an elastically deformable member and a strain gage is attached to the projecting portion of the convex shape, and when the push detecting means detects a push on the input key, the direction detecting means detects a strain by means of the strain gage attached to the projecting portion of the convex shape, to detect a direction of a force exerted on the input key.

4. The input apparatus according to claim 3, further comprising controlling means for, during a push operation on an input key, outputting assignment information of a plurality of input information elements to the input key at a time of the operation, to an external display device and for making the display device highlight information of an input candidate corresponding to the push operation at the time out of the plurality of input information elements.

* * * * *